US006232938B1

(12) United States Patent
Tsuchida et al.

(10) Patent No.: US 6,232,938 B1
(45) Date of Patent: May 15, 2001

(54) LIQUID CRYSTAL DISPLAY DEVICE WITH LOW POWER CONSUMPTION AND HIGH PICTURE QUALITY

(75) Inventors: Katsuya Tsuchida; Goh Itoh, both of Yokohama; Haruhiko Okumura, Fujisawa, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/192,569

(22) Filed: Nov. 17, 1998

(30) Foreign Application Priority Data

Nov. 18, 1997 (JP) ..... 9-317387

(51) Int. Cl.[7] ..... G09G 3/36

(52) U.S. Cl. ..... 345/88; 345/90; 345/103; 345/204; 349/74; 349/77; 349/78; 349/83

(58) Field of Search ..... 349/74–84; 359/53; 345/88, 103, 204

(56) References Cited

U.S. PATENT DOCUMENTS 4,581,608 * 4/1986 Aftergut et al. ..... 345/88
4,726,663 * 2/1988 Buzak ..... 349/80

(List continued on next page.)

FOREIGN PATENT DOCUMENTS 9-26596 1/1991 (JP) .
6-248460 9/1994 (JP) .
7-007969 1/1995 (JP) .
7-235357 9/1995 (JP) .
8-057531 3/1996 (JP) .
8-86998 4/1996 (JP) .
8-201771 8/1996 (JP) .
8-328031 12/1996 (JP) .
8-313939 3/1997 (JP) .
9-80488 3/1997 (JP) .

OTHER PUBLICATIONS

G. Itoh et al., "Advanced Multi–Field–Driving Method for Low Power TFT–LCDs", J. ITE (Journal of The Institute of Television Engineers) Japan, vol. 50, No. 5, pp. 563–569, (1996).

(List continued on next page.)

*Primary Examiner*—Bipin Shalwala
*Assistant Examiner*—David L. Lewis
(74) *Attorney, Agent, or Firm*—Finnegan, Henderson, Farabow, Garrett & Dunner, L.L.P.

(57) ABSTRACT

The liquid crystal display device, comprising a first liquid crystal cell having first pixels arranged in a matrix shape, the first liquid crystal cell having a first sub-field and a second sub-field, a second liquid crystal cell having second pixels arranged in the matrix shape, the second liquid crystal cell being stacked with the first liquid crystal cell so as to form picture elements, and a circuit for selecting and driving the first pixels and the second pixels in each of the first sub-field and the second sub-field so that a difference between a brightness of the picture elements in the first sub-field and a brightness of the picture elements in the second sub-field is compensated. The circuit is capable of supplying data signals to the first pixels and the second pixels in independent timings so that the sum of the elapsed time after the data signals are applied to the first pixels and the elapsed time after the data signals are applied to the second pixels is substantially the same between the picture elements in the first sub-field and the picture elements in the second sub-field. Thus, the liquid crystal display device with low power consumption and free from the deterioration of picture quality can be accomplished.

11 Claims, 35 Drawing Sheets

U.S. PATENT DOCUMENTS

| | | | | |
|---|---|---|---|---|
| 4,843,381 | * | 6/1989 | Baron | 345/88 |
| 5,113,272 | * | 5/1992 | Reamey | 359/53 |
| 5,184,234 | * | 2/1993 | Mathewson | 359/53 |
| 5,208,686 | * | 5/1993 | Fergason | 349/79 |
| 5,457,551 | * | 10/1995 | Cutler et al. | 359/53 |
| 5,790,215 | * | 8/1998 | Sugahara et al. | 349/74 |
| 5,796,447 | * | 8/1998 | Okumura et al. | 349/77 |

OTHER PUBLICATIONS

G. Itoh et al., "Improvement of Image Quality on Low Power TFT–LCDs using Multi–Field Driving Method", Euro Display '96, pp. 487–490, (1996).

H. Okumura et al., "Multi–Field Driving Method for Reducing LCD Power Consumption", SID 95 DIGEST, pp. 249–252, (1995).

G. Itoh et al., "Advanced Multi–Field–Driving Method for Low Power TFT–LCD", Asia Display '95, pp. 493–496, (1995).

H. Okumura et al., "Low–Power–Consumption Driving Technology for TFT–LCDs", Toshiba Review, vol. 50, No. 9, pp. 691–694, (1995), (English language Abstract Only).

T. Motai et al. "Dynamic Characteristics of Leakage Current in Amorphous Silicon Thin Film Transistors", Journal of The Institute of Electronics, Information, and Communication Engineers, C–II, vol. J76–C–II, No. 5, pp. 199–203, (1993).

K. Sunohara et al., "Relfective Color LCD Composed of Stacked Films of Encapsulated Liquid Crystal (SFELIC)", SID 98 DIGEST, pp. 762–765 (1998).

Y. Nakai et al., "Reflective Tri–Layer Guest–Host Color TFT–LCD", SID 97 DIGEST, pp. 83–86, (1997).

K. Hyugaji et al., "CMOS Driver LSIs for Megapixel Multi–Color TFT–LCDs", SID 91 DIGEST, pp. 543–546, (1991).

* cited by examiner

T1
T2
T3
Vp1
Vp2
Vp3
Vcom
Vp

VGD

VGM

VGU

LIQUID CRYSTAL DISPLAY DEVICE WITH LOW POWER CONSUMPTION AND HIGH PICTURE QUALITY

BACKGROUND OF THE INVENTION

1. Field of the Invention

The present invention relates to a liquid crystal display device, in particular, to a liquid crystal display device having a plurality of liquid crystal layers stacked to compose a display screen. In addition, the present invention relates to a liquid crystal display device capable of displaying an image with high quality and low power consumption.

2. Description of the Related Art

As display devices for use with OA electronic devices such as personal computers, word-processors, and EWS (Engineering Work-Stations), display devices for use with personal electronic devices such as electronic calculators, electronic books, electronic notebooks, and PDA, and display devices for use with portable electronic devices such as portable TV units, portable telephone units, and portable FAX units, flat display devices are becoming attractive. Since display devices for use with portable electronic devices are battery-driven, the power consumption should be reduced.

Conventionally, as flat type display devices, liquid crystal display devices (LCD), plasma display panels (PDP), flat CRTs, and so forth are known. Among these flat display devices, from a view point of low power consumption, the LCDs are the most suitable and have been widely used.

An LCD of which the user directly sees a picture on the screen of the display is referred to as direct view type. In addition, the direct view type LCD can be categorized as a transmission LCD and a reflective LCD. The transmission LCD has a light source such as a fluorescent lamp disposed on the rear side of liquid crystal cells. On the other hand, the reflective LCD uses peripheral light as its light source. Since the transmission LCD uses such a back-light, the reflective LCD is superior to the transmission LCD from a view point of the power consumption. This is because the back-light consumes a power of 1 W or higher. Thus, as displays for use with portable electronic devices such as portable digital assistance devices, reflective LCDs have been widely used.

In the reflective LCD, from a view point of efficiency of light, GH (Guest Host) type display mode is the most suitable for that does not use a polarizer. In the GH type color display, three layers of GH mode liquid crystal cells that respectively contain dichroic dye materials of three primary colors such as cyan, magenta, and yellow should be disposed.

To display color images in a wide color reproducing range with a reflective liquid crystal display device, the layered structure of the GH liquid crystal cells is the most suitable. On the other hand, in the structure of the RGB parallel arrangement or CMY parallel arrangement, with all pixels that compose a display screen, the same color cannot be shown at the same time. Thus, the color reproducing range of the LCD become narrow.

When a dot-matrix screen is formed of such three-layer GH liquid crystal cells, data signals corresponding to the picture information should be transmitted to respective pixels that compose the display screen. As the matrix driving method, simple matrix driving method and active matrix driving method are known.

Since the simple matrix driving method requires a sharp V-T (Voltage-Transmittance) characteristic, it is not suitable for driving GH liquid crystal of which the content of a liquid crystal material is small due to the presence of color agents.

As an active matrix type LCD, the structure of which MIM (Metal-Insulator-Metal) diodes or thin film transistors are used as active element (switching elements having a non-linear characteristics).

In the method employing MIMs, as the number of pixels that composes the display screen increases, the effective voltage applied to each pixel decreases. Thus, the effective voltage applied to each pixel may decrease to 5 V or less. Consequently, from a view point of the V-T characteristic of the currently available GH liquid crystal, the MIM method is not suitable for driving the GH liquid crystal.

On the other hand, in the TET method, a voltage applied to each pixel that composes the display screen can be freely set. Thus, the active matrix driving method using TFTs is suitable for the driving method of the GH liquid crystal.

From the above-described background, a reflective display device having the structure of a plurality of GH liquid crystal layers has been proposed in for example Japanese Patent Application No. 8-57531. Hereinafter, such a device is referred to as tri-layer GH LCD. In addition, a method for driving such a tri-layer GH LCD has been proposed in Japanese Patent Application No. 7-235357.

The above-described tri-layer GH LCD can be structured as a transmission LCD having a back-light instead of a reflective LCD having a reflecting plate. In this case, since a color filter is not required, a display device with high efficiency of light and low power consumption can be structured.

On the other hand, as a driving method that allows the power consumption of tri-layer GH color LCD to decrease, multi-field driving method (MF driving method) has been proposed. In the multi-field driving method, one frame picture is divided into a plurality of sub-fields that are sequentially displayed. Thus, the power consumption can be decreased. However, in the multi-field driving method, the picture quality may deteriorate due to line disturbance (Cf. Japanese Patent Application No. 6-248460; Go. Itoh et al. "Advanced Multi-Field Driving Method for Low Power TFT-LCDs", J. ITE Japan, Vol. 50, No. 5, pp. 563–569 (1996); Go. Itoh et al. "Improvement of Image Quality on Low Power TFT-LCDs using Multi-Field Driving Method", Euro Display '96).

This is because the user recognizes the variation of colors two-dimensionally (as a plane) and the variation of brightness one-dimensionally (as a line). Thus, when the LCD is driven by the multi-field driving method, the user recognizes the boundary between sub-fields displayed in different timings.

Thus, technologies that accomplish an LCD that satisfies high picture quality and low power consumption are required.

SUMMARY OF THE INVENTION

The present invention is made from the above-described point of view. In other words, an object of the present invention is to provide an LCD having high displaying quality and low power consumption. Another object of the present invention is to reduce the power consumption of an active matrix LCD having the structure of a plurality of liquid crystal layers such as a tri-layer LCD without a deterioration of the displaying quality.

To solve such a problem, the liquid crystal display device according to the present invention has the following structure.

A first aspect of the present invention is a liquid crystal display device, comprising a first liquid crystal cell having first pixels arranged in a matrix shape, the first liquid crystal cell having a first sub-field and a second sub-field, a second liquid crystal cell having second pixels arranged in the matrix shape, the second liquid crystal cell being overlapped with the first liquid crystal cell so as to form picture elements, and at least a means for selecting and driving the first pixels and the second pixels in each of the first sub-field and the second sub-field so that a difference between a brightness of the picture elements in the first sub-field and a brightness of the picture elements in the second sub-field is compensated.

The picture elements may be composed of a plurality of pixels that are stacked or arranged in parallel. For example, the picture elements may be composed of pixels of C (cyan), M (magenta), and Y (yellow) that are layered as pixels of three primary colors of subtractive color mixture. Alternatively, the picture elements may be composed of pixels of R (red), G (green), and B (blue) that are arranged in parallel as pixels of three primary colors of additive color mixture. When the present invention is applied to a reflective LCD, pixels of a plurality of liquid crystal cells are layered as picture elements. On the other hand, when the present invention is applied to a transmission type LCD, pixels of a plurality of liquid crystal cells are arranged in parallel as picture elements.

The selecting and driving means may select and drive the first pixels and the second pixels in each of the first sub-field and the second sub-field at independent timings so that a difference between a brightness of the picture elements in the first sub-field and a brightness of the picture elements in the second sub-field is compensated.

Another aspect of the present invention is a liquid crystal display device, comprising a first liquid crystal cell having first pixel electrodes arranged in a matrix shape, the first liquid crystal cell having a first sub-field and a second sub-field, a second liquid crystal cell having second pixel electrodes arranged in the matrix shape, the second liquid crystal cell being overlapped with the first liquid crystal cell in such a manner that the second pixel electrodes and the first pixel electrodes are layered so as to form picture elements, and at least a means for selecting and driving the first pixel electrodes and the second pixel electrodes in each of the first sub-field and the second sub-field at independent timings so that the difference between the brightness of the picture elements in the first sub-field and the brightness of the picture elements in the second sub-field is compensated.

Another aspect of the present invention is a liquid crystal display device, comprising a first liquid crystal cell having first pixels arranged in a matrix shape, the first liquid crystal cell having a first sub-field and a second sub-field, a second liquid crystal cell having second pixels arranged in the matrix shape, the second liquid crystal cell being overlapped with the first liquid crystal cell in such a manner that the second pixels and the first pixels are layered so as to form picture elements, a first driving means for driving the first pixels in each of the first sub-field and the second sub-field, a second driving means for driving the second pixels in each of the first sub-field and the second sub-field, and at least a means for independently selecting driving timings of the first sub-field and the second sub-field of the first driving means and the second driving means so that the difference between the rightness of the picture elements in the first sub-field and the brightness of the picture elements in the second sub-field is compensated.

Another aspect of the present invention is a liquid crystal display device, comprising a first liquid crystal cell having first pixel electrodes arranged in a matrix shape, the first liquid crystal cell having a first sub-field and a second sub-field, a second liquid crystal cell having second pixel electrodes arranged in the matrix shape, the second liquid crystal cell being overlapped with the first liquid crystal cell in such a manner that the second pixel electrodes and the first pixel electrodes are layered so as to form picture elements, and a driving means for supplying data signals to the first pixel electrodes in the first sub-field at a first timing, supplying data signals to the first pixel electrodes at a second timing, supplying data signals to the second pixel electrodes in the first sub-field at the first timing, and supplying data signals to the second pixel electrodes in the second sub-field at the first timing.

A second aspect of the present invention is a liquid crystal display device, comprising a first liquid crystal cell having first pixel electrodes arranged in a matrix shape, a second liquid crystal cell having second pixel electrodes arranged in the matrix shape, the second liquid crystal cell being overlapped with the first liquid crystal cell, and a driving means for supplying data signals to the first pixel electrodes and the second pixel electrodes at independent timings.

Another aspect of the present invention is a liquid crystal display device, comprising a first liquid crystal cell having first pixel electrodes arranged in a matrix shape, a second liquid crystal cell having second pixel electrodes arranged in a matrix shape in such a manner that the second pixel electrodes are layered with the first pixel electrodes, and a driving means for supplying data signals to the first pixel electrodes and the second pixel electrodes at independent timings.

In the liquid crystal display apparatus of the invention, since one picture element is composed of a plurality of pixel overlapped or arranged in parallel, the gate of thin film transistors whose sources and drains are connected to respective pixel electrodes are connected to a plurality of address lines so as to supply data signals to the pixel electrodes on the individual layers at independent timings.

Each of the first liquid crystal cell and the second liquid crystal cell has liquid crystal layer and pixel electrodes that are disposed so that respective liquid crystal layer electromagnetically interact with the pixel electrodes. A data signal voltage applied to each pixel electrode causes an electric field to take place. The electric field corresponding to a potential of the pixel electrode causes the alignment state or phase state of a relevant liquid crystal layer to vary. In the first liquid crystal cell and the second liquid crystal cell, the first pixel electrodes and the second pixel electrodes are arranged in the matrix shape, respectively.

When GH layers of three primary colors of C (cyan), M (magenta), and Y (yellow) as subtractive color mixture are laminated, each picture element is composed of three pixels of CMY stacked or arranged in parallel. Data signals are independently supplied through respective thin film transistors to individual pixels that composes a picture element.

For example, a thin film transistor (TFT) or an MIM non-linear switching element is disposed on each pixel electrode. The switching elements independently select and apply data signals to individual pixel electrodes.

For example, when a thin film transistor for selecting a pixel electrode to apply the data signal, the gate electrode of the thin film transistor is connected to an address line. The source electrode of the thin film transistor is connected to a pixel electrode. The drain electrode of the thin film transistor is connected to a data line. An address driver supplies an address signal to the address line so as to control the conduction of the source and drain of the thin film transistor. A data driver supplies a data signal to the data line. In such a structure, when the thin film transistor turns on with the address signal, the data signal supplied through the data line is sampled and applied to the pixel electrode through the source and drain of the thin film transistor. Therefore, potentials of respective pixel electrodes are controlled corresponding to data signals. Thus, the individual pixel electrodes two-dimensionally arranged in the pixel electrode array can be independently driven.

Alternatively, a data signal may be supplied as a digital form data signal rather than an analog form voltage. The digital data signal may be sampled, converted into an analog signal by a D/A converter (digital/analog converter), and supplied to the pixel electrode.

The first sub-field and the second sub-field may be formed as picture elements, lines or columns of thereof, or a matrix thereof.

For example, it is assumed that the number of picture elements that compose a display screen is "A" (the number of pixel electrodes that are laminated with three layers or arranged in parallel is "3A"). In the multi-field driving method, when a picture is displayed with "A" picture elements arranged in a matrix shape, one frame picture is divided into n sub-fields and successively displayed along the time axis.

Each sub-field may be composed of for example ("A"/n×m) picture elements (where "A" is a plus integer that represents the number of picture elements that compose the display screen; "n" is a plus integer that represents the number of sub-frames that is in the range from 3 to A; and "m" is a plus integer that is "n" or less).

In addition, it is assumed that the number of lines or rows of picture elements that compose the display screen and that are arranged in a matrix shape (for example, the number of address lines of one liquid crystal cell) is "A" (when pixel electrodes are stacked with three layers or arranged in parallel, the number of address lines is "3A"). In the multi-field driving method, when pixel electrodes are selected for "A" picture elements at a time, one frame picture is divided into "n" sub-fields and successively displayed along the time axis. Each sub-field may be composed of lines of (A/n×m) picture elements (where "A" is a plus integer that represents the number of lines of picture elements that compose one display screen; "n" is a plus integer in the range from 3 to "A" that represents the number of sub-fields; and "m" is a plus integer that is "n" or less).

In the multi-field driving method, as the number of sub-fields increases, the brightness difference between sub-fields is recognized. Thus, the picture quality deteriorates. In a display device of which a plurality of liquid crystal cells are overlapped, the white balance gets lost and the picture quality deteriorates due to a feed-through phenomenon in the gate electrode of a thin film transistor.

In the liquid crystal display device according to the present invention, one frame picture is divided into "n" sub-fields on each of a plurality of liquid crystal layers each of which has "A" pixels or address lines with respective switching elements. Each sub-field is composed of (A/n×m) pixels or address lines (where "A") is a plus integer; "n" is a plus integer in the range from "3" to "A" that represents the number of sub-fields; and "m" is a plus integer that is n or less). In addition, with at least a means for changing the selection order of address lines that compose each sub-field in each of the liquid crystal layers, the brightness difference between sub-fields is compensated. Thus, the picture quality is improved.

Moreover, with at least a means for causing waveforms of address signals applied to address lines that compose each sub-field to be dulled, the brightness difference between sub-fields is composed. Thus, the picture quality can be improved.

These and other objects, features and advantages of the present invention will become more apparent in light of the following detailed description includes a best mode embodiment thereof, as illustrated in the accompanying drawings.

DESCRIPTION OF THE PREFERRED EMBODIMENTS

Next, with reference to the accompanying drawings, preferred embodiments of the present invention will be described.

(First Embodiment)

Figure 1:
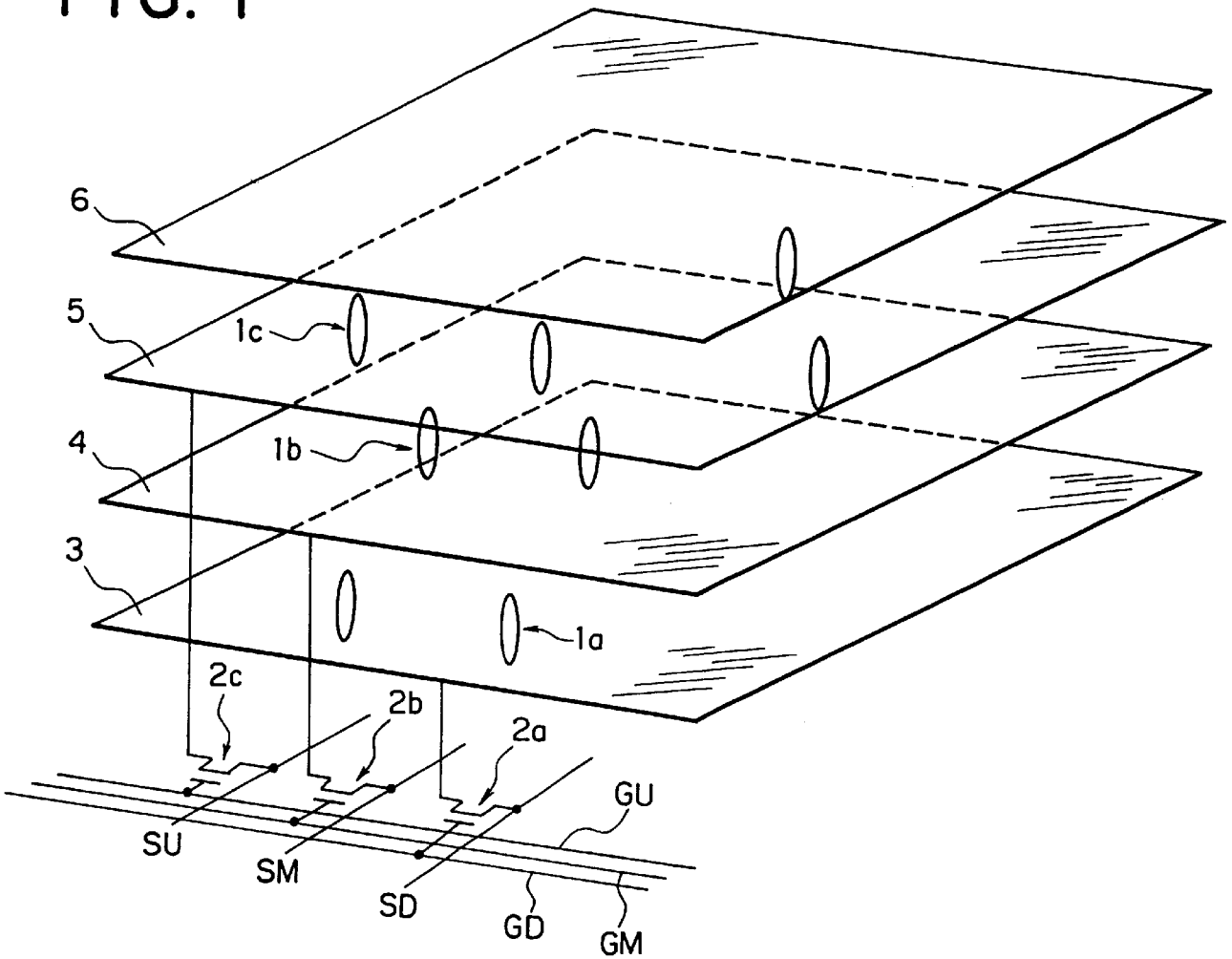
FIG. 1 is a perspective view showing an example of the structure of an LCD according to the present invention.
Figure 2:
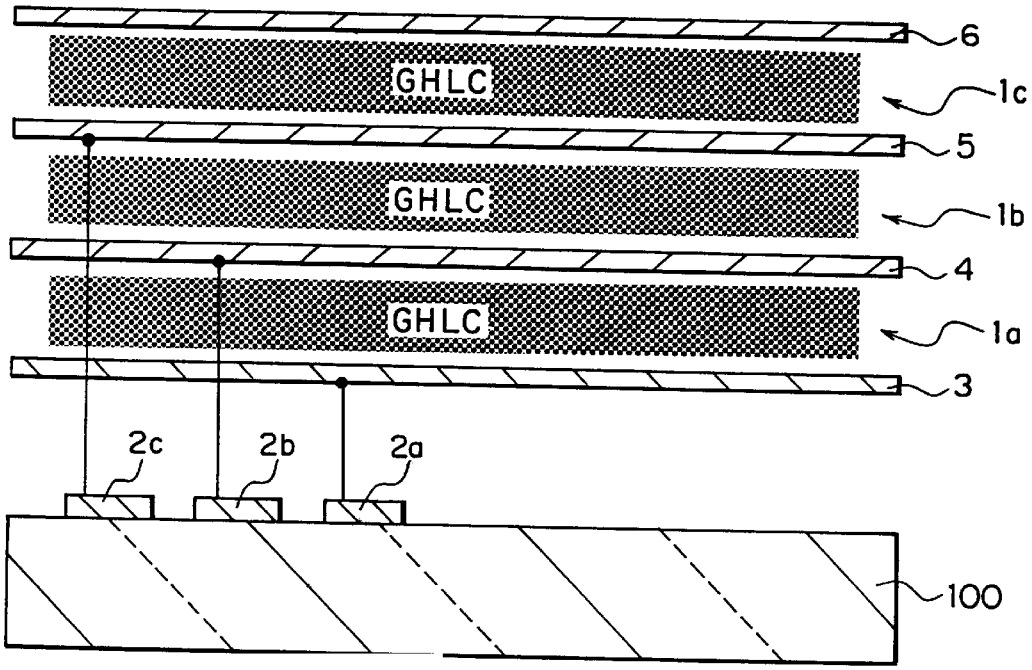
FIG. 2 is a sectional view showing the structure of a pixel shown in FIG. 1.

FIG. 1 is a perspective view showing an example of the structure of an LCD according to the present invention. FIG. 2 is a sectional view showing the structure of the LCD according to the present invention shown in FIG. 1. In FIG. 1 and FIG. 2 show the structure of an unit pixel.

Referring to FIG. 2, a plurality of TFTs 2*a*, 2*b*, and 2*c* are formed on an array substrate 100. A reflective pixel electrode 3 is disposed on the array substrate 100 intervening an insulating film such as SiNx or SiOx. The reflective pixel electrode 3 is composed of aluminum or the like having a high reflective index. Liquid crystal layers 1*a*, 1*b*, and 1*c* are successively stacked on the reflective pixel electrode 3. For example, GH liquid crystal layers of yellow, magenta, and cyan may be stacked or overlapped. The stack order of the layers is not fixed but defined as required. A transparent pixel electrode 4 is interposed between the liquid crystal layers 1*a* and 1*b*. A transparent pixel electrode 5 is interposed between the liquid crystal layers 1*b* and 1*c*.

An opposite substrate (not shown) having a transparent counter electrode e6 is disposed on the liquid crystal layer 1*c*. The counter electrode may be disposed for each liquid crystal layer.

The TFT 2*a* and the reflective pixel electrode 3 are electrically connected. The TFT 2*b* and the transparent pixel electrode 4 are electrically connected. The TFT 2*c* and the transparent pixel electrode 5 are electrically connected. In other words, address signals are supplied from an address driver (not shown) to the gate electrodes of individual TFTs through address lines GDi, GMi, and GUi. Data signals are applied from a data driver (not shown) to the drain electrodes of the individual TFTs via data lines SDi, SMi, and SUi.

When a TFT is turned on with an address signal, a data signal applied on the data line at that time is selected. The data signal is supplied to each pixel electrode connected to the source electrode of the TFTs. Electric fields generated corresponding to a potential of the individual pixel electrodes affect the liquid crystal layers 1*a*, 1*b*, and 1*c*. By controlling the alignment states and phase change states of the liquid crystal layers 1*a*, 1*b*, and 1*c*, the intensity of light that enters the liquid crystal layers is modulated. Such pixels that are light intensity modulating elements are arranged two-dimensionally in the matrix. To modulate an intensity of the light two-dimensionally by matrix of the pixels allows to display an image.

The fabrication method of the LCD shown in FIG. 1 and the materials of the structural portions 1*a*, 1*b*, 1*c*, 3, 4, and 5 may be referred to Japanese Patent Application No. 8-57531.

Figure 3:
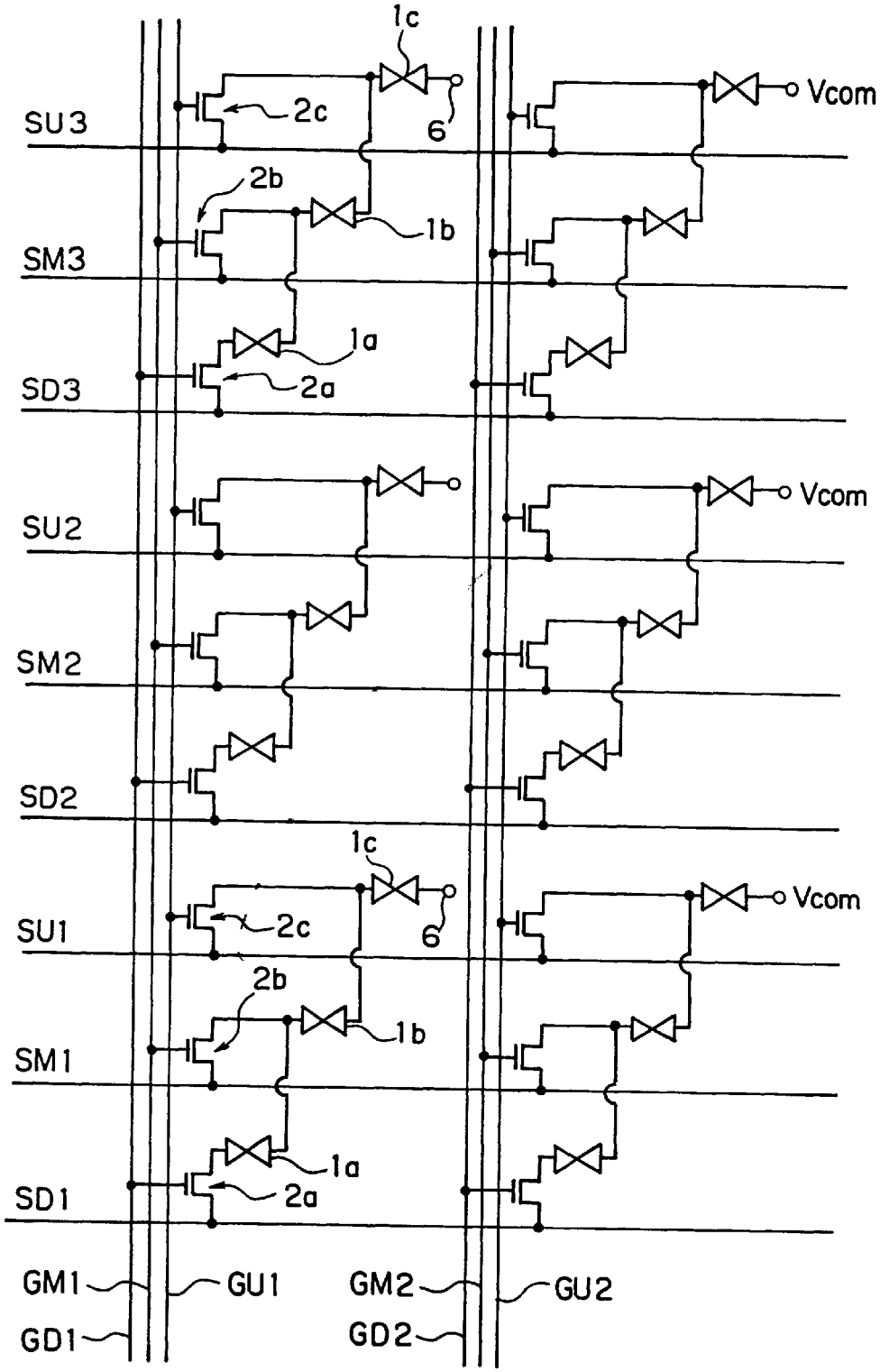
FIG. 3 is a schematic diagram showing an example of an equivalent circuit of the LCD according to the present invention.
Figure 4:
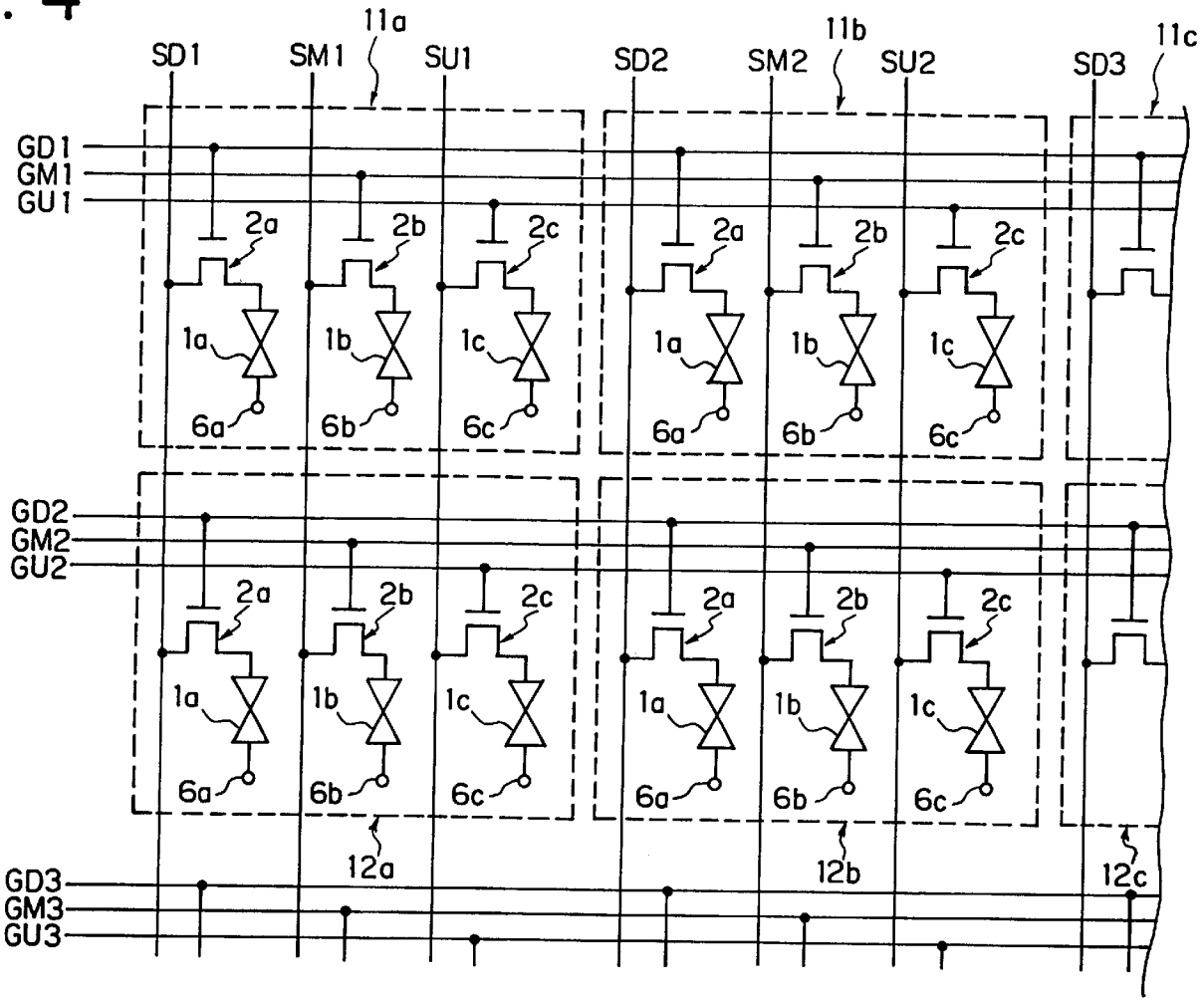
FIG. 4 is a schematic diagram showing another example of the equivalent circuit of the LCD according to the present invention.

FIG. 3 and FIG. 4 are schematic diagrams showing equivalent circuits of the LCD according to the present invention shown in FIG. 1 and FIG. 2.

TFTs connected to the data lines SDi (SD1, SD2, SD3, and SDn) control the reflective pixel electrode 3. TFTs connected to the data lines SMi (SM1, SM2, SM3, and SMn) control the transparent pixel electrode 4. TFTs connected to the data lines SUi (SU1, SU2, SU3, and SDn) control the transparent pixel electrode 5. In other words, although these TFTs and data lines are illustrated as in a plane in FIG. 3, however, they are actually stacked as layers. In FIG. 3, Ca, Cb, and Cc represent capacities of the liquid crystal layers 1*a*, 1*b*, and 1*c*, respectively; Vcom represents a voltage applied to the counter electrode 6; SD1 to SD3, SM1 to SM3, and SU1 to SU3 represent data lines; and GDi, GMi, and GUi represent address lines that independently supply address signals to switching elements corresponding to pixels on the individual layers.

Referring to FIG. 4, each of tri-layered pixels that compose one picture element has three address lines GDi, GMi, and GUi so as to selectively supply data signals. Likewise, each of the counter electrodes (6*a*, 6*b*, and 6*c*) has the three address lines GDi, GMi, and GUi.

Figure 5A:
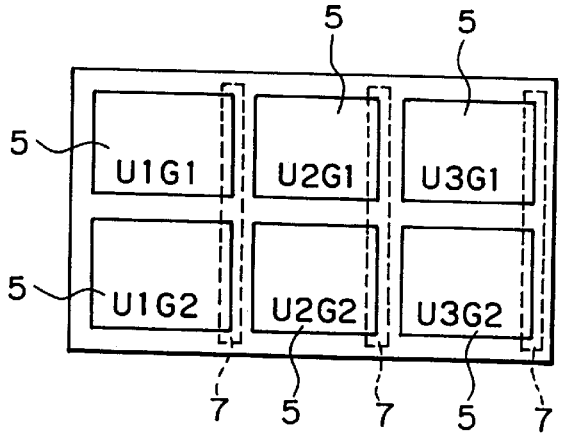
FIG. 5A, FIG. 5B, and FIG. 5C are plan views showing the structures of pixels on individual layers of the LCD according to the present invention.
Figure 5B:
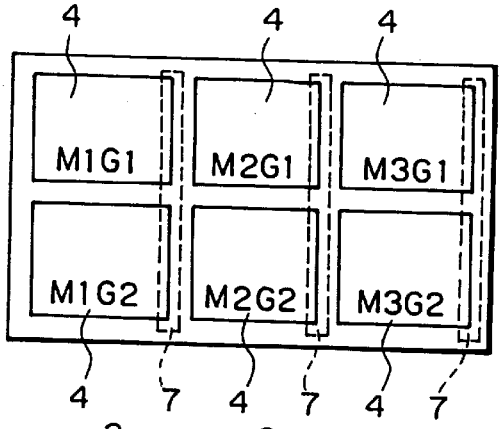
Figure 5C:
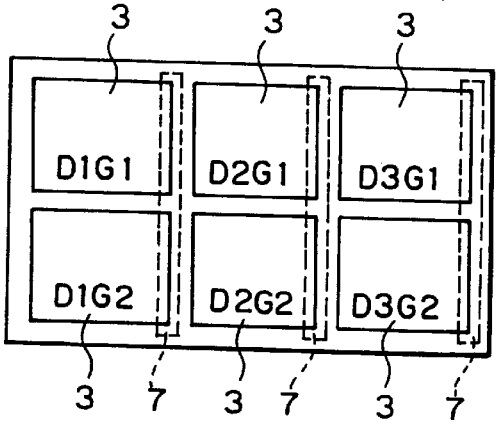

FIG. 5A, FIG. 5B, and FIG. 5C are plan views showing the structures of pixels of a plurality of liquid crystal layers that compose the LCD according to the present invention.

In FIG. 5A, FIG. 5B, and FIG. 5C, an area 7 represents an area of which the counter electrode 6 is not disposed on an opposite substrate 9. U1G1 represents the transparent pixel electrode 5 controlled with the TFT 2*c* controlled with U1 and G1.

Figure 6:
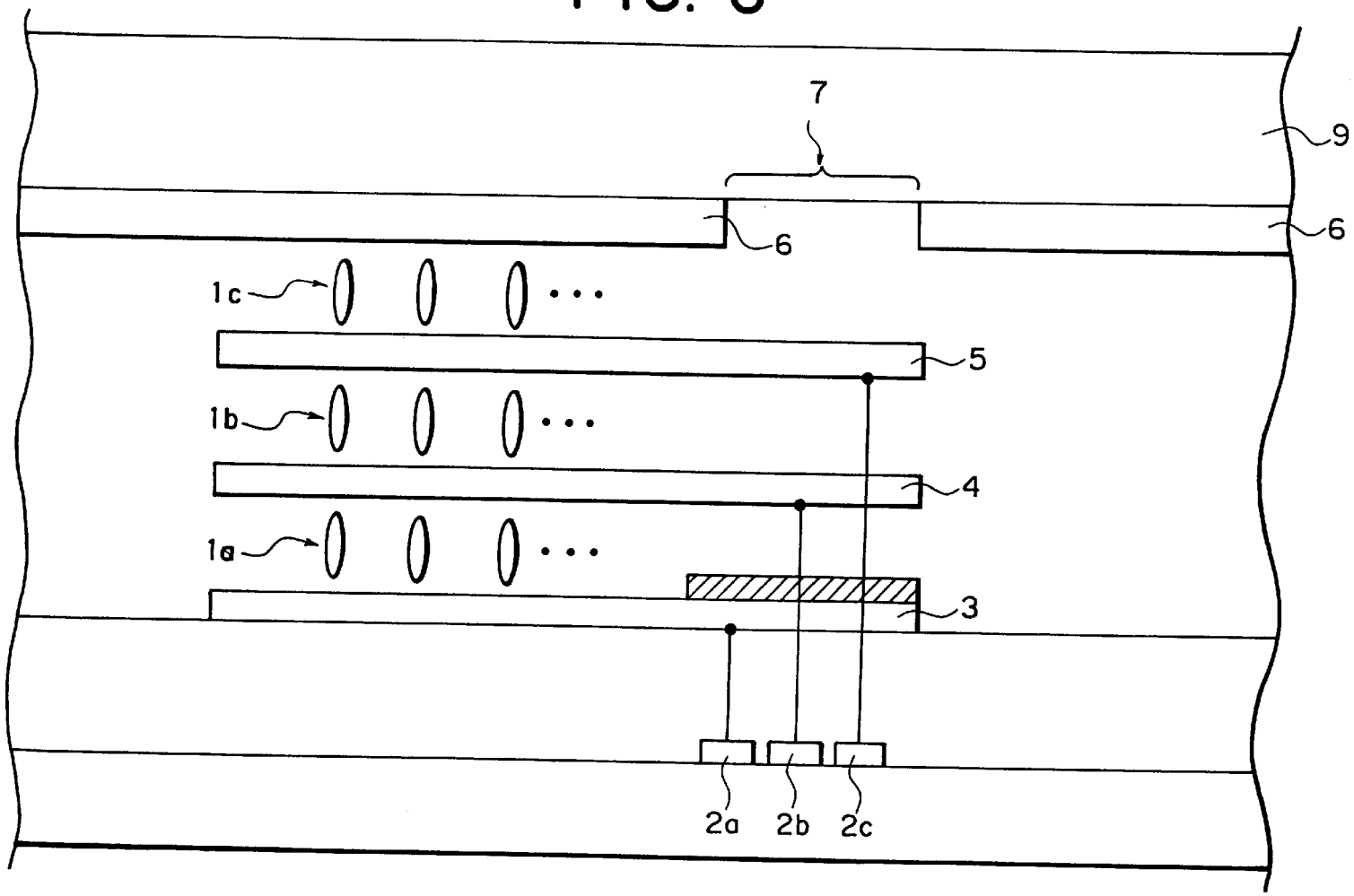
FIG. 6 is a sectional view showing the structure of a picture element of the LCD according to the present invention.

FIG. 6 is a sectional view showing the layers of the LCD shown in FIG. 5A, FIG. 5B, and FIG. 5C. An area on which a TFT is light-insulated with a light insulating layer 8. When there is an area 7 in which the counter electrode 6 is not disposed, the area 7 cannot be controlled with the transparent pixel electrode 5. Thus, the area 7 causes the picture quality to deteriorate. The light insulating layer 8 light-insulates the area 7 so as to prevent the displayed image quality from deteriorating.

Figure 7:
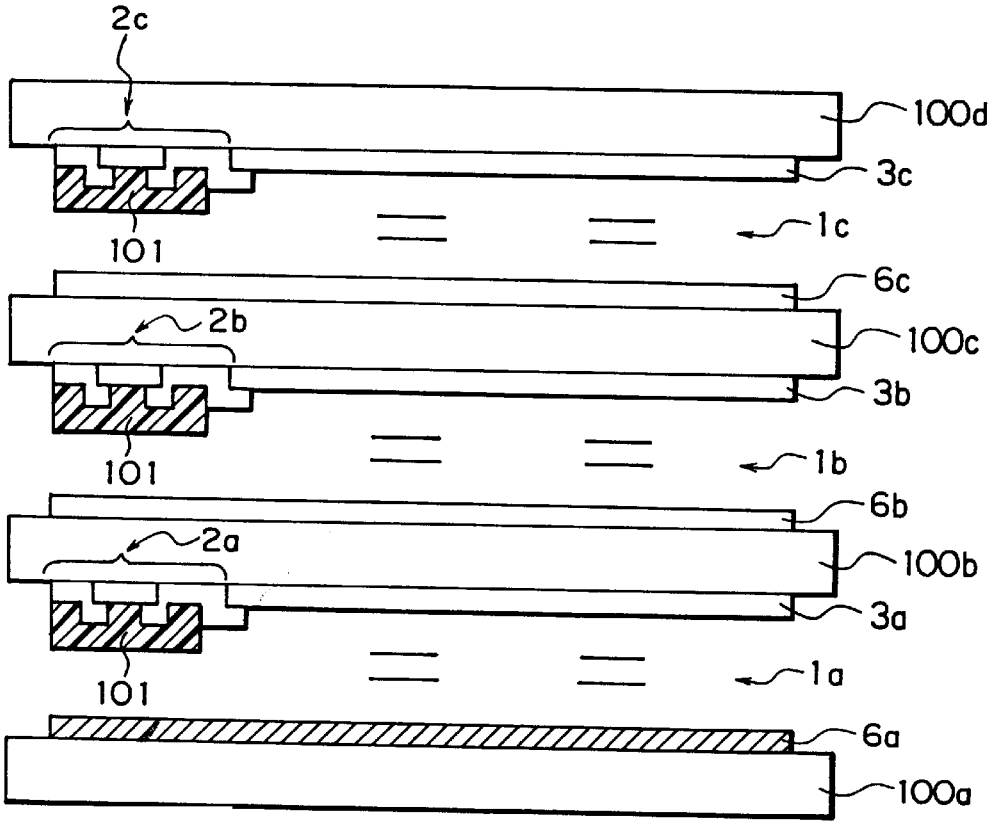
FIG. 7 is a sectional view showing an example of the structure of the LCD according to the present invention.

FIG. 7 is a sectional view showing an example of the structure of a picture element of the LCD according to the present invention.

The LCD has three liquid crystal layers that are for example, a yellow liquid crystal layer 1*a,* a cyan liquid crystal layer 1*b,* and a magenta liquid crystal layer 1*c.* Each liquid crystal layer is separated by a substrate composed of for example non-alkali glass or a transparent insulating film. In other words, the liquid crystal layer 1*a* is interposed between a substrate 100*a* and a substrate 100*b.* The liquid crystal layer 1*b* is interposed between the substrate 100*b* and a substrate 100*c.* The liquid crystal layer 1*c* is interposed between the substrate 100*c* and a substrate 100*d.*

A pixel electrode 3*a* that has a light transmitting characteristic that causes the liquid crystal layer 1*a* to electromagnetically respond is disposed on a liquid crystal layer interposed side of the substrate 100*b.* Likewise, pixel electrodes 3*b* and 3*c* are disposed on the respective liquid crystal layer faced to the substrates 100*c* and 100*d,* respectively. Thin film transistors 2*a,* 2*b,* and 2*c* that select data signals are connected to the pixel electrodes 3*a,* 3*b,* and 3*c,* respectively. A light insulating layer 101 is disposed on each of the thin film transistors 2*a,* 2*b,* and 2*c.*

An counter electrode (common electrode) 6*a* that generates an electric field with the respective electrode 3*a* and causes the liquid crystal layer 1*a* to electromagnetically respond is disposed on the other liquid crystal layer interposed face of the substrate 100*a.* Likewise, counter electrodes 6*b* and 6*c* are disposed on the relevant liquid crystal layer interposed faces of the substrates 100*b* and 100*c,* respectively. The counter electrodes 6*b* and 6*c* are composed of such chemicals as ITO (Indium Tin Oxide) that has light transmitting characteristics. In contrast, the counter electrode 6*a* is a reflecting electrode that is composed of for example aluminum that has a high reflecting characteristic.

The equivalent circuit of the LCD shown in FIG. 7 is the same as that shown in FIG. 4. In other words, the gate electrodes of the thin film transistors 2*a,* 2*b,* and 2*c* are connected to address lines GDi, GMi, and GUi, respectively and independently. The thin film transistors connected to the pixel electrodes of the liquid crystal layers 1*a,* 1*b,* and 1*c* that compose picture elements can be turned on/off at independent timings.

FIG. 2 and FIG. 7 show the structure of a reflective LCD. However, the present invention can be applied to a TFT-LCD having a lamination structure of a plurality of liquid crystal layers. For example, the present invention can be applied to a transmission LCD as well as a TFT-LCD.

Figure 8:
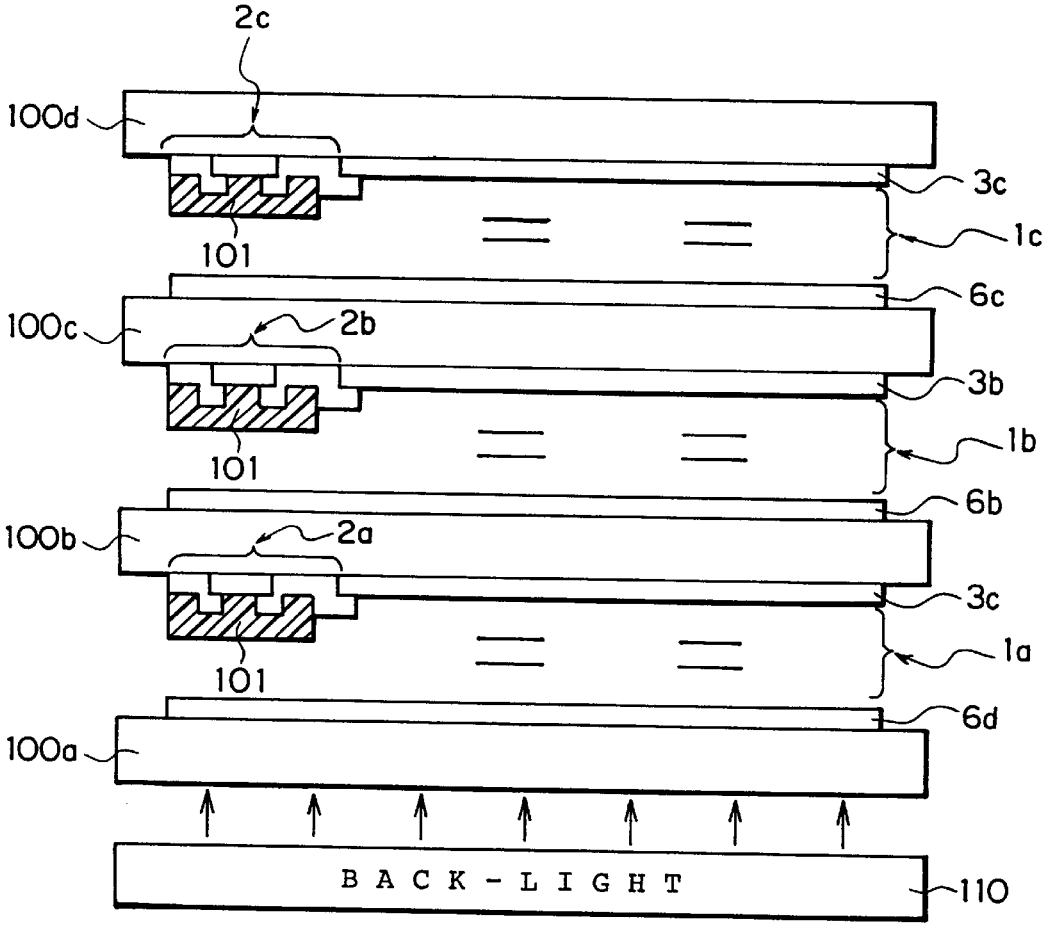
FIG. 8 is a sectional view showing another example of the structure of the LCD according to the present invention.

FIG. 8 is a sectional view showing the structure of a transmission LCD according to the present invention instead of the reflective LCD shown in FIG. 7.

In the LCD shown in FIG. 8, a transparent pixel electrode 6*d* instead of a reflective electrode 6*a* is disposed on a glass substrate 100*a* so that a back-light 110 emits light from the outside of the glass substrate 100*a.*

In the structures shown in FIG. 7 and FIG. 8, each of the thin film transistors disposed on the pixel electrodes 3*a,* 3*b,* and 3*c* arranged in the matrix shape on the individual liquid crystal layers, has a switching element. The LCD according to the present invention is for example a VGA LCD, an SVGA LCD, or an XGA LCD that has a plurality of picture elements structured as shown in FIG. 1, FIG. 2, FIG. 7, and FIG. 8 and arranged as shown in FIG. 4.

The gate electrodes of the thin film transistors 2*a,* 2*b,* and 2*c* connected to individual pixel electrodes are connected to the address lines GDi, GMi, and GUi, respectively. The source and drain electrodes of the thin film transistors 2*a,* 2*b,* and 2*c* are connected to the data lines SDi, SMi, and SUi, respectively (see FIG. 4). The address lines GDi, GMi, and GUi are connected to an address driver. The data lines SDi, SMi, and SUi are connected to a data driver. The address driver and the data driver may be independently disposed on each layer. Alternatively, the address driver and the data driver may be connected to a plurality of layers in common.

In the LCDs that have the structures shown in FIG. 7 and FIG. 8, the thin film transistors 2*a,* 2*b,* and 2*c* and the relevant driving circuits may be integrally formed on the substrates 100*b,* 100*c,* and 100*d,* respectively. In this case, the thin film transistors that compose the driving circuits and the thin film transistors that compose pixels are preferably composed of poly-Si or $\mu$c-Si as channel of the semiconductors.

In the example, each picture element is composed of a plurality of pixels of liquid crystal cells that are overlapped. Alternatively, each picture element may be composed of a plurality of pixels of liquid crystal cells that are arranged in parallel.

(Second Embodiment)

FIG. 9, FIG. 10, FIG. 11A, FIG. 11B, FIG. 11C, and FIG. 11D are schematic diagrams for explaining the operation of the LCD according to the present invention.

In the second embodiment, the LCD according to the present invention is driven by the multi-field driving method It should be noted that the driving method for the LCD according to the present invention is not limited to the multi-field driving method. Instead, the LCD according to the present invention can be driven by the normal driving method. In the multi-field driving method, one frame picture is divided into a plurality of sub-frames sequentially displayed. Therefore, the rewriting frequency of the screen is decreased. Thus, the power consumption of the LCD is decreased (refer to H. Okumura et al., SID '95 Digest, 249, 1995; G. Itoh et al., ASIA DISPLAY '95, 493, 1997; Japanese Patent Application No. 6-248460; Toshiba Review 1995, Vol. 50, No. 9, pp. 691–694; Journal of The Institute of Television Engineers, Japan, Vol. 50, No. 5, pp. 563–569, 1996).

In the multi-field driving method, a display screen of a plurality of liquid crystal cells each of which has (m×n) picture elements arranged in a matrix array shape divided into a plurality of sub-fields to drive.

Figure 9:
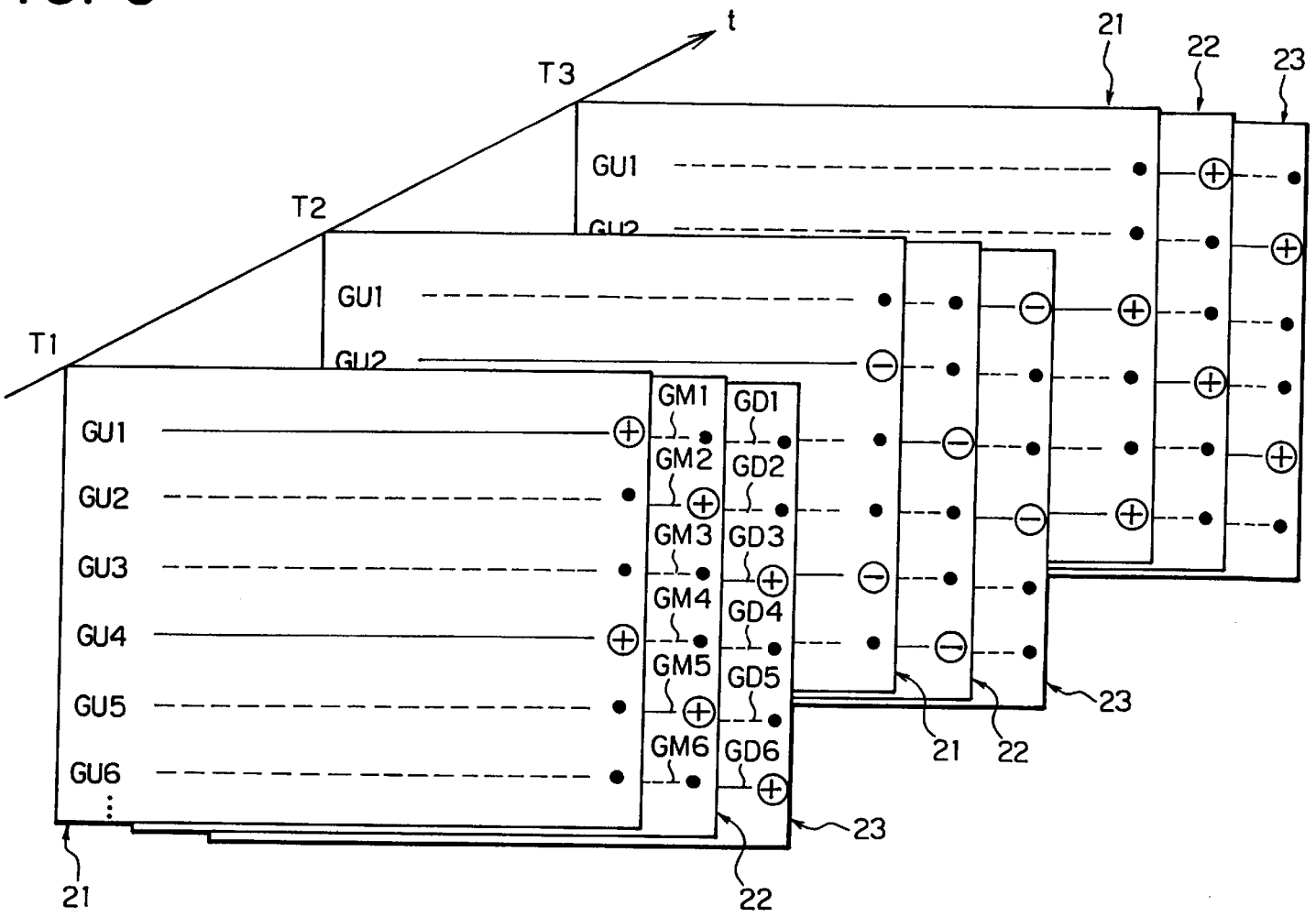
FIG. 9 is a schematic diagram for explaining the operation of the LCD according to the present invention.

In the example shown in FIG. 9, the display screen is divided into three sub-fields to drive. In this example, picture elements connected to m address lines Gi (where $1 \leqq i \leqq m$) of individual liquid crystal cells are divided into three sub-fields corresponding to address lines G(3k−2) (for example, i=1, 4, 7, . . . 3k−2), G(3k−1) (for example, i=2, 5, 8, . . . 3k−1), and G(3k) (for example, i=3, 6, 9, . . , 3k).

When the LCD is driven by the multi-field driving method, the fluctuation of the holding voltage of a pixel electrode due to a leak current in the off state of a thin film transistor causes the brightness difference to take place among the sub-field composed of picture elements connected to the address lines G(3k−2), the sub-field composed of picture elements connected to the address lines G(3k−1), and the sub-field composed of picture elements connected to the address lines G(3k) . Thus, the brightness difference is recognized. Consequently, the picture quality deteriorate.

The LCD according to the present invention has at least a means for selecting and driving each pixel of a plurality of overlapped liquid crystal cells in each sub-field so as to compensate the brightness difference between picture elements in different sub-fields. Thus, an LCD with low power consumption can be accomplished without reducing a quality of a displaying image.

In FIG. 9, reference numerals 21, 22, and 23 represent liquid crystal cells overlapped corresponding to the liquid crystal layers 1*c,* 1*b,* and 1*a* shown in FIG. 7, respectively.

In FIG. 9, GUi represent address lines connected to the thin film transistors 2*c* connected to the pixel electrodes 3*c* of the liquid crystal cell 21. GMi represent address lines connected to the thin film transistors 2*b* connected to the pixel electrodes 3*b* of the liquid crystal cell 22. GDi represent address lines connected to the thin film transistors 2*a* connected to the pixel electrodes 3*a* of the liquid crystal cell 23.

In FIG. 9, solid lines represent selected address lines, whereas dotted lines represent non-selected address lines. In addition, a plus sign represents that a data signal having a positive polarity is applying to a selected address line, whereas a minus sign represents that a data signal having a negative polarity is applying to a selected address line (refer to Toshiba Review, 1995, Vol. 50, No. 9, FIG. 2 of P. 692; Journal of The Institute of Television Engineers, Japan, Vol. 50, No. 5, pp. 563–569, 1996).

Due to an off-leakage current of the thin film transistors 2*a,* 2*b,* and 2*c,* the brightness of a selected address line is different from the brightness of a non-selected address line (refer to Journal of The Institute of Television Engineers, Japan, Vol. 50, Vo. 5, pp. 563–569, 1996; Journal of The Institute of Electronics, Information, and Communication Engineers, C-II, Vol, J76-C-II, No. 5, pp. 199–203).

FIG. 11A, FIG. 11B, FIG. 11C, and FIG. 11D are graphs for explaining wave profiles in the multi-field driving method.

Figures 11A, 11B, 11C, 11D:
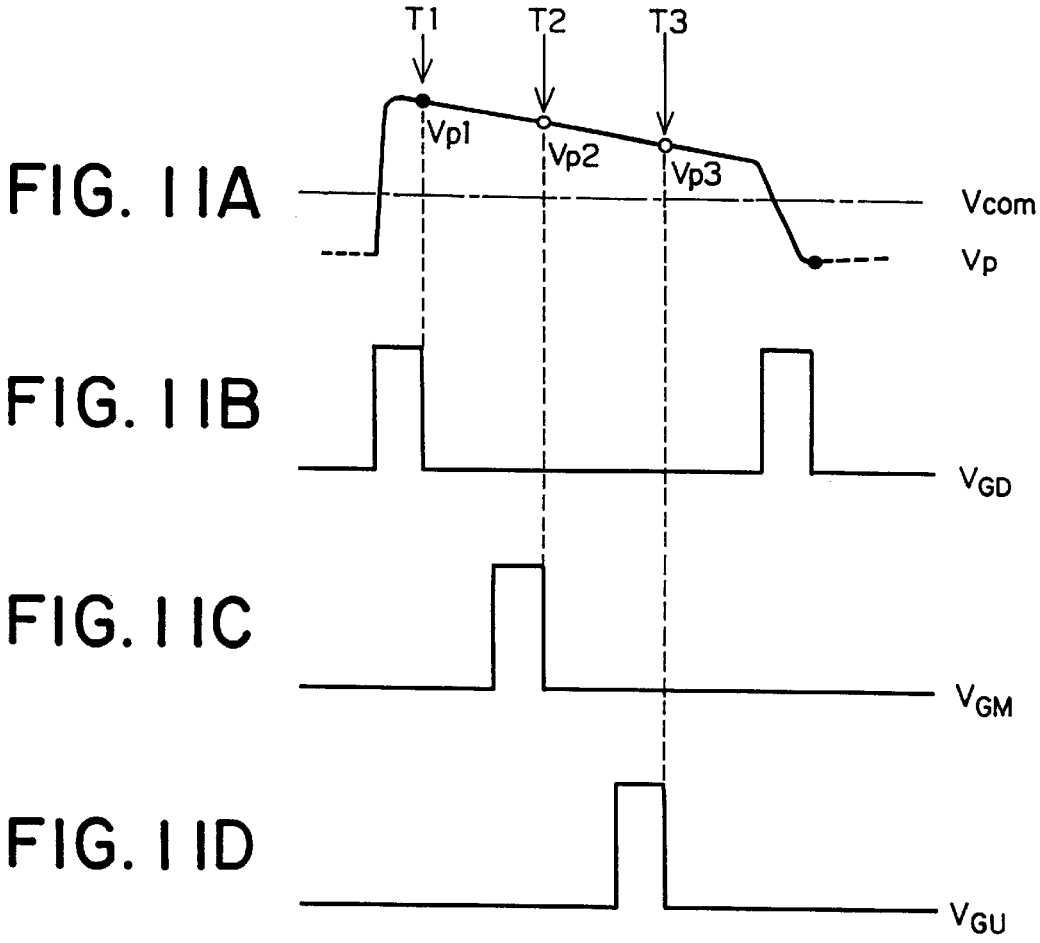
FIG. 11A, FIG. 11B, FIG. 11C, and FIG. 11D are graphs for explaining the operation of the LCD according to the present invention.

FIG. 11A shows a waveform of a holding voltage Vp applied to a pixel of the liquid crystal cell 21. FIG. 11B shows a waveform of an address signal voltage VGU applied to the address lines GUi of the liquid crystal cell 21. FIG. 11C shows a waveform of an address signal voltage VGM applied to the address lines GMi of the liquid crystal cell 22. FIG. 11D shows a waveform of an address signal voltage VGD applied to the address lines GDi of the liquid crystal cell 23.

Now, it is assumed that a data signal Vp1 is applied to pixels connected to the address lines G(3k−2) (for example, i=1, 4, 7, . . . , 3k−2). In this case, the second sub-field (namely, pixels connected to the address lines G(3k−1) and the third sub-field (namely, pixels connected to the address lines G(3k)) are in the non-selected state. The level of voltage held by these pixels drop corresponding to the elapsed time after the data write point that is prior to t=T1.

Thus, the brightness of pixels in one sub-field of one liquid crystal cell is different from the brightness of pixels in another sub-field of the same liquid crystal cell. For example, when data signals are applied to pixel electrodes in the second sub-field at t=T2, the level of the voltage held by the pixel electrodes in the first sub-field drop to Vp2. When data signals are applied to pixel electrodes in the third sub-field at t=T3, the level of the voltage held by the pixel electrodes in the first sub-field drop to Vp3.

Figure 10:
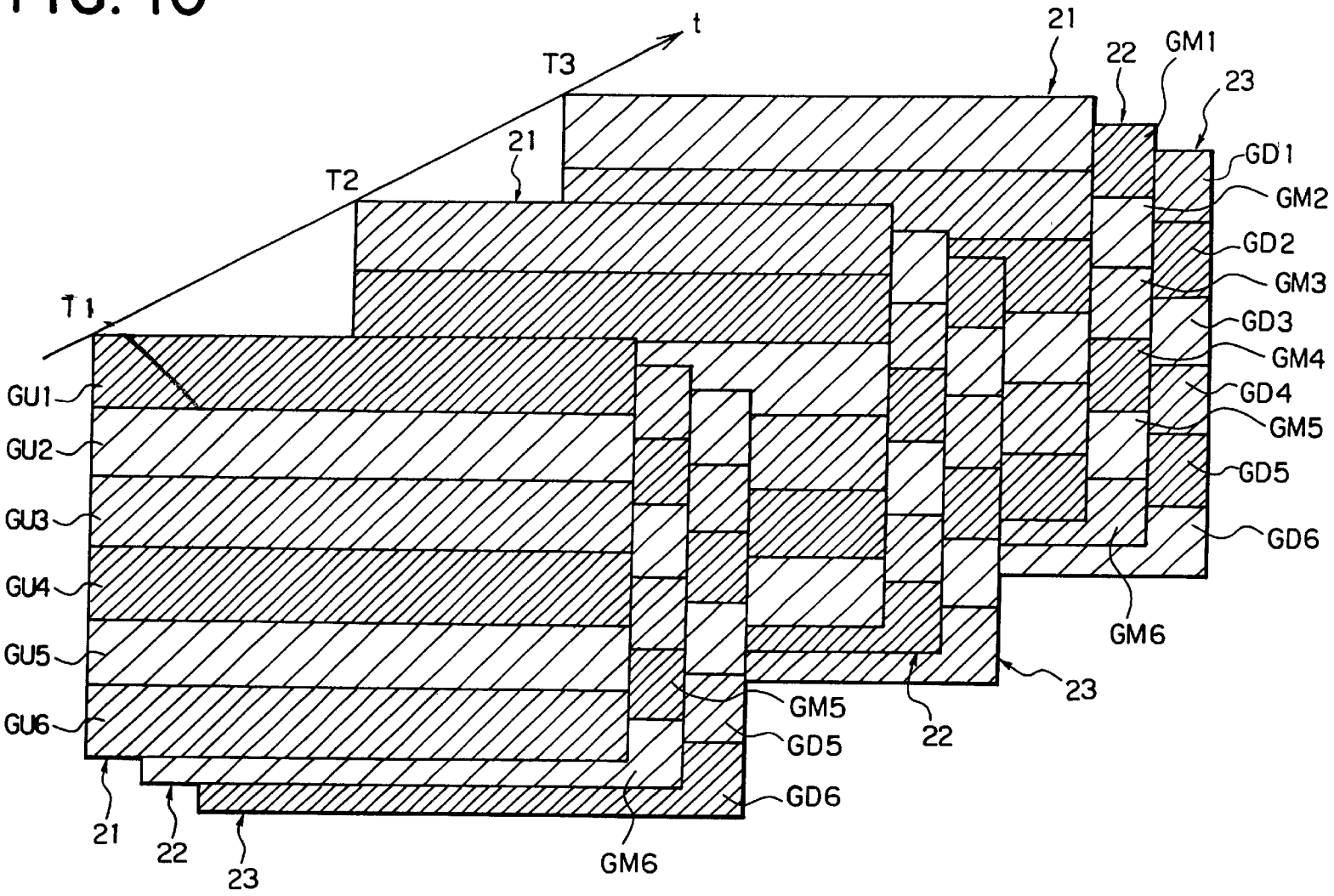
FIG. 10 is a schematic diagram for explaining the operation of the LCD according to the present invention.

FIG. 10 is a schematic diagram for explaining the brightness of pixels in each sub-field according to the present invention.

Figure 12:
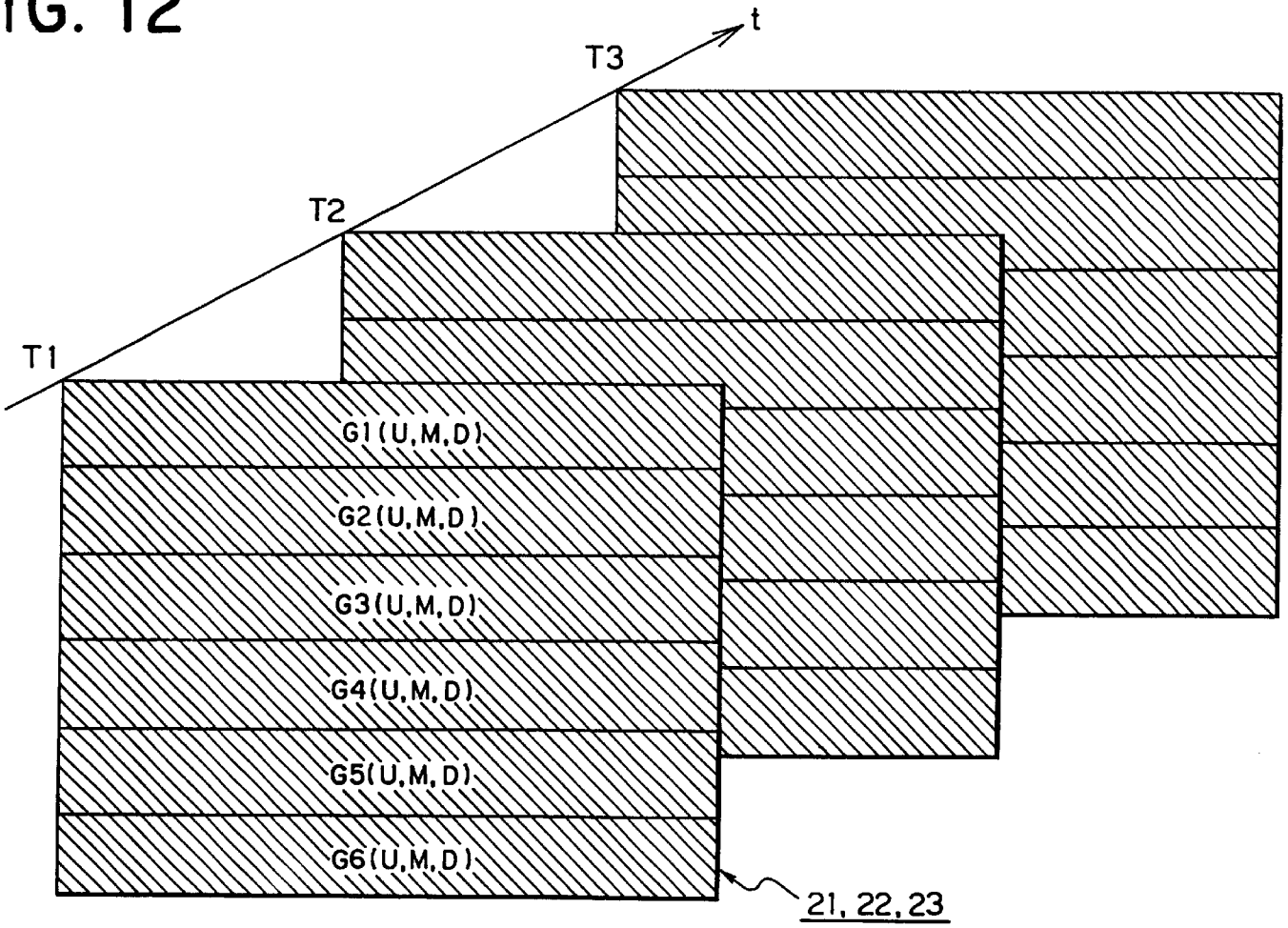
FIG. 12 is a schematic diagram for explaining the state of the brightness of each picture element in the case that the LCD according to the present invention is driven by the multi-field driving method.

FIG. 12 is a schematic diagram for explaining the brightness of each picture element in the case that the LCD according to the present invention shown in FIG. 12 is driven by the multi-field driving method.

It is assumed that the period of one field is 1/60 sec, that the holding ratio after the period of one field is 95% (assuming that the voltage at which a voltage is applied to a pixel electrode is 100%), and that the display mode is normally white mode, due to off-leakage current of the thin film transistors 2*a,* 2*b,* and 2*c,* the deviation of the brightness as shown in FIG. 10 takes place in different sub-fields of each of the liquid crystal cells 21, 22, and 23. The density of hatched lines of each sub-field shown in FIG. 10 is proportional to the intensity of the brightness.

In the LCD according to the present invention, each of three pixels of three overlapped liquid crystal cells that compose one picture element connected to an independent address line. The LCD has at least a means for controlling the selection timings of the independent address lines so as to compensate the difference of the brightness between picture elements in different sub-fields.

For example, at t=T1, the first sub-field of the liquid crystal cell 21 (namely, the address lines GU1, GU4, GU(3k−2)), the second sub-field of the liquid crystal cell 22 (namely, the address lines GM2, GM5, and G(3k−1)), and the third sub-field of the liquid crystal cell 23 (namely, the address lines GD3, GD6, and GD(3k)) are selected with positive polarity.

For example, at t=T2, the first sub-field of the liquid crystal cell 23 (namely, the address lines GD1, GD4, and GD(3k−2)), the second sub-field of the liquid crystal cell 21 (namely, the address lines GU2, GU5, and GU(3k−1)), and the third sub-field of the liquid crystal cell 22 (namely, the address lines GM3, GM6, and GM(3k)) are selected.

Likewise, at t=T3, the first sub-field of the liquid crystal cell 22 (namely, the address lines GM1, GM4, and GM(3k−2)), the second sub-field of the liquid crystal cell 23 (namely, the address lines GD2, GD5, and GD(3k−1)), and the third sub-field of the liquid crystal cell 21 (namely, the address lines GU3, GU6, and GU(3k)) are selected.

With respect to the liquid crystal cell 21 at t=T3, since data signals are held for the duration of one field in the pixels connected to the address lines GU2, GU5, and GU(3k−1), the voltage levels of the pixel electrodes become 95% of the level of the data written. Thus, the brightness increases. In addition, since the pixels connected to the address lines GU1, GU4, and GU(3k−2) are held for the duration of two fields, the voltage levels of the pixel electrodes become 90.25% of the level of the data written. Thus, the brightness further increases.

In this case, at t=T3, it is assumed that the brightness of the third sub-field (namely, pixels connected to the address lines GU3, GU6, and GU(3k)) is 100%, that the brightness of the first sub-field is 110%, and that the brightness of the second sub-field is 105%. Such brightness difference takes place in other liquid crystal cells 22 and 23.

Since the LCD according to the present invention has at least a means for selecting and driving pixels of a plurality of liquid crystal cells that compose picture elements in each sub-field so as to compensate the brightness difference between picture elements in different sub-fields. Thus, the picture quality can be improved without an increase of the power consumption.

The selection order of the address lines GUi, GMi, and GDi of each layer is, for example, controlled so that one of three pixels that compose one picture element is always selected at each time point of T1, T2, and T3 and that the sum of the elapsed time after the data write point or the sum of the fluctuation of the holding voltage after the data write point becomes substantially the same in the entire picture element in the screen. Thus, the brightness difference between picture elements in different sub-fields is compensated in each picture element. Consequently, the brightness state shown in FIG. 12 is accomplished.

However, when displaying an image, since liquid crystal cells are stacked, colors of these cells are mixed. Thus, the brightness difference does not take place between address lines. Consequently, an LCD with low power consumption can be accomplished with a decrease of line disturbance.

When the selection order of the address lines Gi is the same in each of the liquid crystal cells 21, 22, and 23 that are layered, such as conventional LCDs, the uneven brightness for each address line due to the brightness difference is recognized.

In contrast, the LCD according to the present invention has at least a means for selecting and driving pixels of a plurality of liquid crystal cells that compose picture elements in each sub-field so as to compensate the brightness difference between picture elements in different sub-fields. Thus, the picture quality can be improved without an increase of the power consumption.

In the equivalent circuit shown in FIG. 4, picture elements 11*a,* 11*b,* and 11*c* are included in the first sub-field. Picture elements 12*a,* 12*b,* and 12*c* are included in the second sub-field. When the LCD according to the present invention is driven by the multi-field driving method (the thin-out driving method) of the present invention, since the brightness difference between picture elements that compose sub-fields is compensated, the brightness difference is not recognized. Thus, the picture quality can be maintained.

(Third Embodiment)

Figure 13:
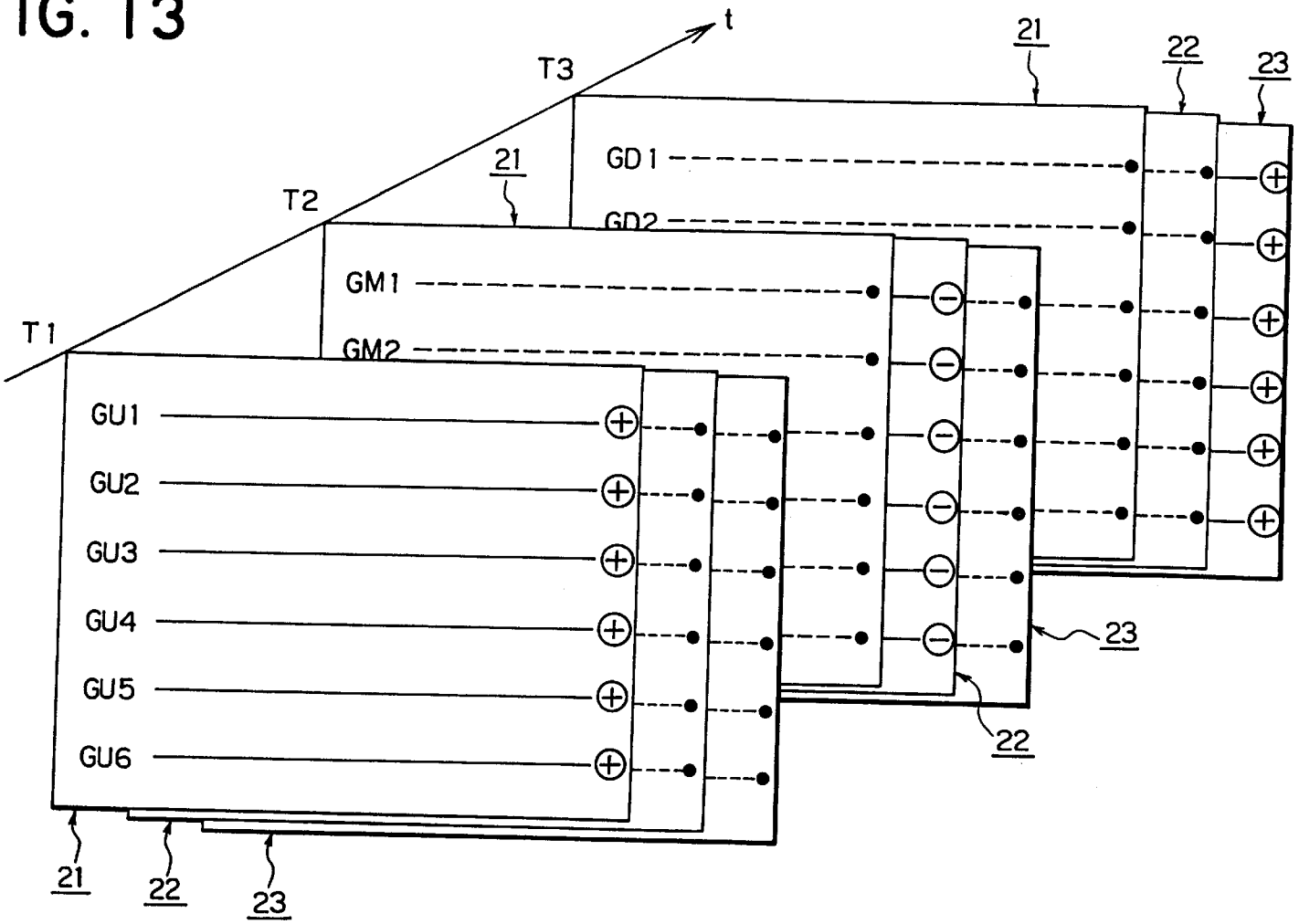
FIG. 13 is a schematic diagram for explaining the operation of the LCD according to the present invention.
Figure 14:
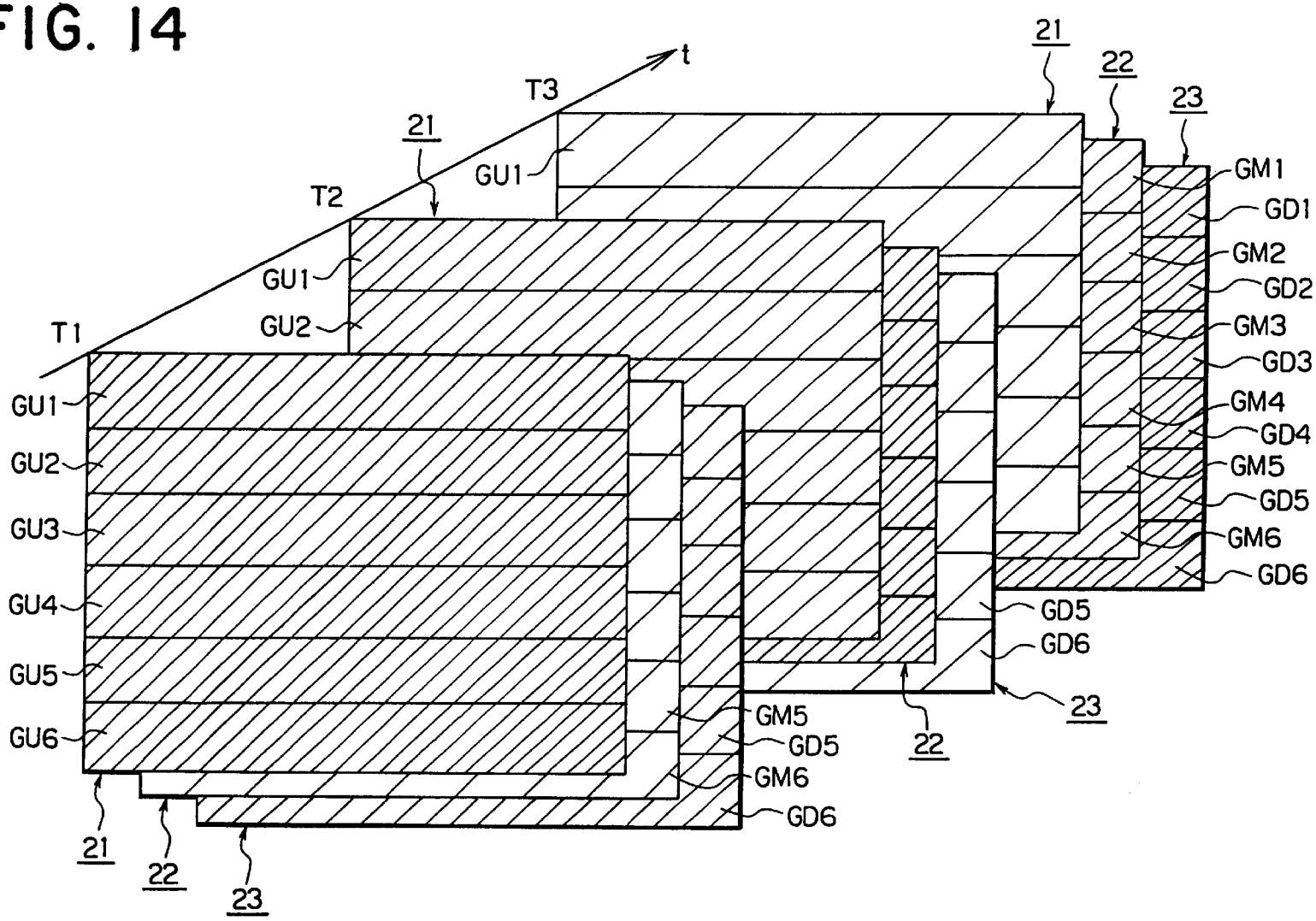
FIG. 14 is a schematic diagram for explaining the operation of the LCD according to the present invention.
Figure 15:
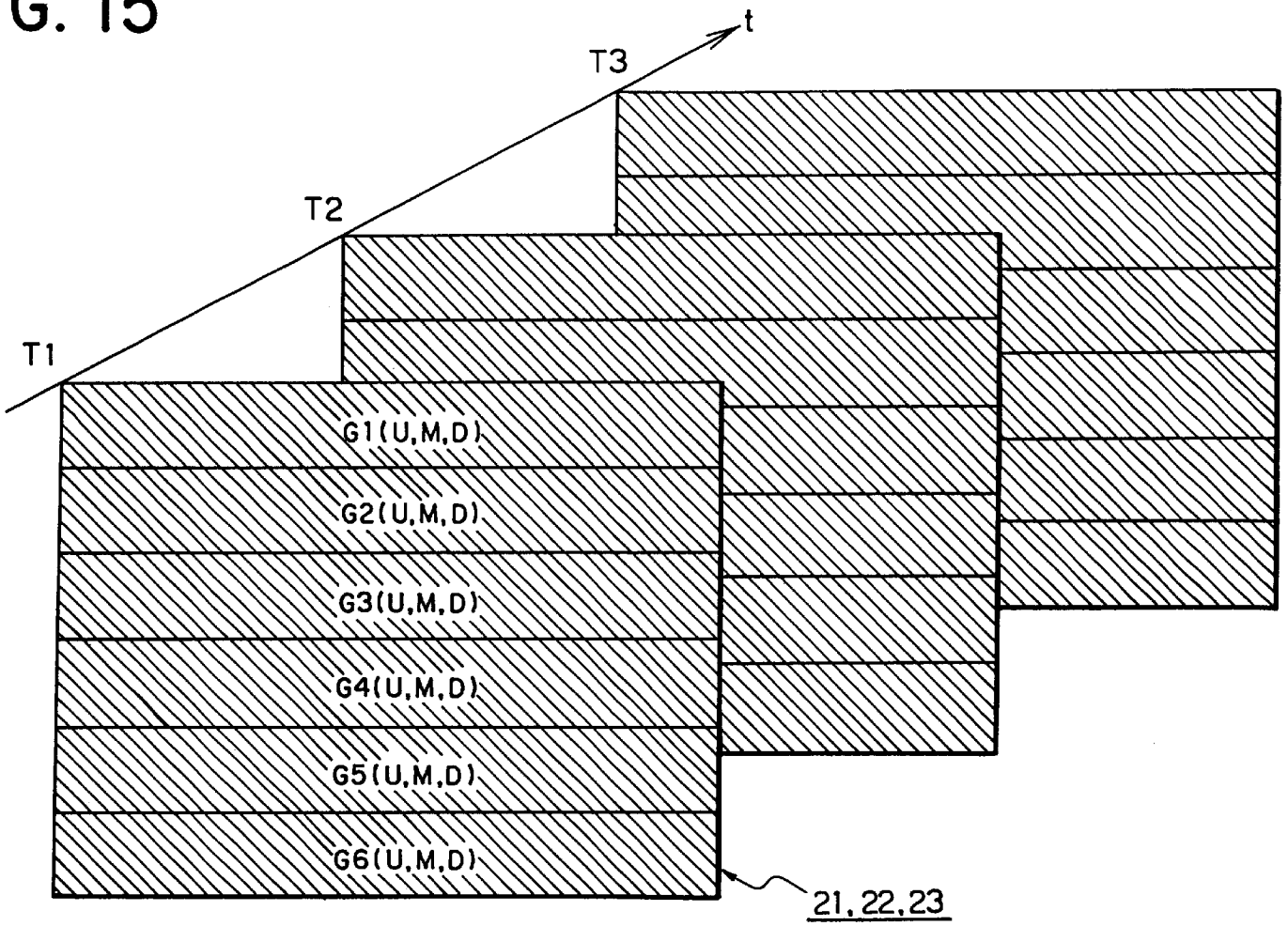
FIG. 15 is a schematic diagram for explaining the operation of the LCD according to the present invention.

FIG. 13, FIG. 14, and FIG. 15 are schematic diagrams for explaining another example of the operation of the LCD according to the present invention.

In FIG. 13, FIG. 14, and FIG. 15, similar portions to those in the second embodiment shown in FIG. 9, FIG. 10, and FIG. 12 are denoted by similar reference numerals.

The driving method shown in FIG. 13 is also a kind of the multi-field driving method. In other words, by decreasing the screen rewriting frequency, the low power consumption is accomplished. FIG. 13 shows the case that one frame picture is divided into three sub-field pictures. In the LCD according to the present invention, a time division method and a space division method are combined.

At t=T1 (in the first sub-field), all address lines of the liquid crystal cell 21 are selected. At t=T2 (in the second sub-field), all address lines of the liquid crystal cell 22 are selected. At t=T3 (in the third sub-field), all address lines of the liquid crystal cell 23 are selected.

All the pixels of the liquid crystal cell 23 at t=T1 hold data signals for the period of one field. Thus, the voltages of the pixel electrodes become 95% of the data write state. Thus, the brightness increases. In addition, all the pixels of the liquid crystal cell 22 hold data signals for the period of two fields. Thus, the voltages of the pixel electrodes become 90.25% of the data write state. Consequently, the brightness further increases (in this case, it is assumed that the brightness of pixels connected to all address lines of the liquid crystal cell 21 is 100%, that the brightness of pixels connected to all address lines of the liquid crystal cell 22 is 110%, and that the brightness of pixels connected to all address lines of the liquid crystal cell 23 is 105%).

This applies to other sub-fields. In reality, the pixel electrode voltage difference and the brightness difference take place for each address line corresponding to the selection order thereof in the same liquid crystal layer of the same sub-field. However, these differences are smaller than those that take place between different sub-fields. Thus, these differences do not adversely affect the picture quality. In addition, the difference between holding duration of the signal voltages that depends on the selection order of address lines in the same sub-field hardly affect the picture quality.

When the selection order of address lines are the same for each of the liquid crystal cells 21, 22, and 23, the uneven brightness of each address line due to the brightness difference is recognized. Thus, the picture quality deteriorates.

In contrast, the LCD according to the present invention has at least a means for selecting and driving pixels of a plurality of liquid crystal cells that compose picture elements in each sub-field so as to compensate the brightness difference between picture elements in different sub-fields. Thus, the picture quality can be improved without an increase of the power consumption. The selection order of the address lines GUi, GMi, and GDi of each layer is, for example, controlled so that one of three pixels that compose one picture element is always selected at each time point of T1, T2, and T3 and that the sum of the elapsed time after the data write point or the sum of the fluctuation of the holding voltage after the data write point becomes almost the same in the entire picture element. Thus, the brightness difference between picture elements in different sub-fields is compensated in each picture element. Consequently, the brightness state shown in FIG. 15 is accomplished. However, when displaying an image, since liquid crystal cells are stacked, colors of these cells are mixed. Thus, the brightness difference does not take place between address lines. Consequently, an LCD with low power consumption can be accomplished with a decrease of line disturbance.

(Fourth Embodiment)

Next, an example of the structure of an LCD is driven as with the second and third embodiments will be described as a fourth embodiment of the present invention.

Figure 16:
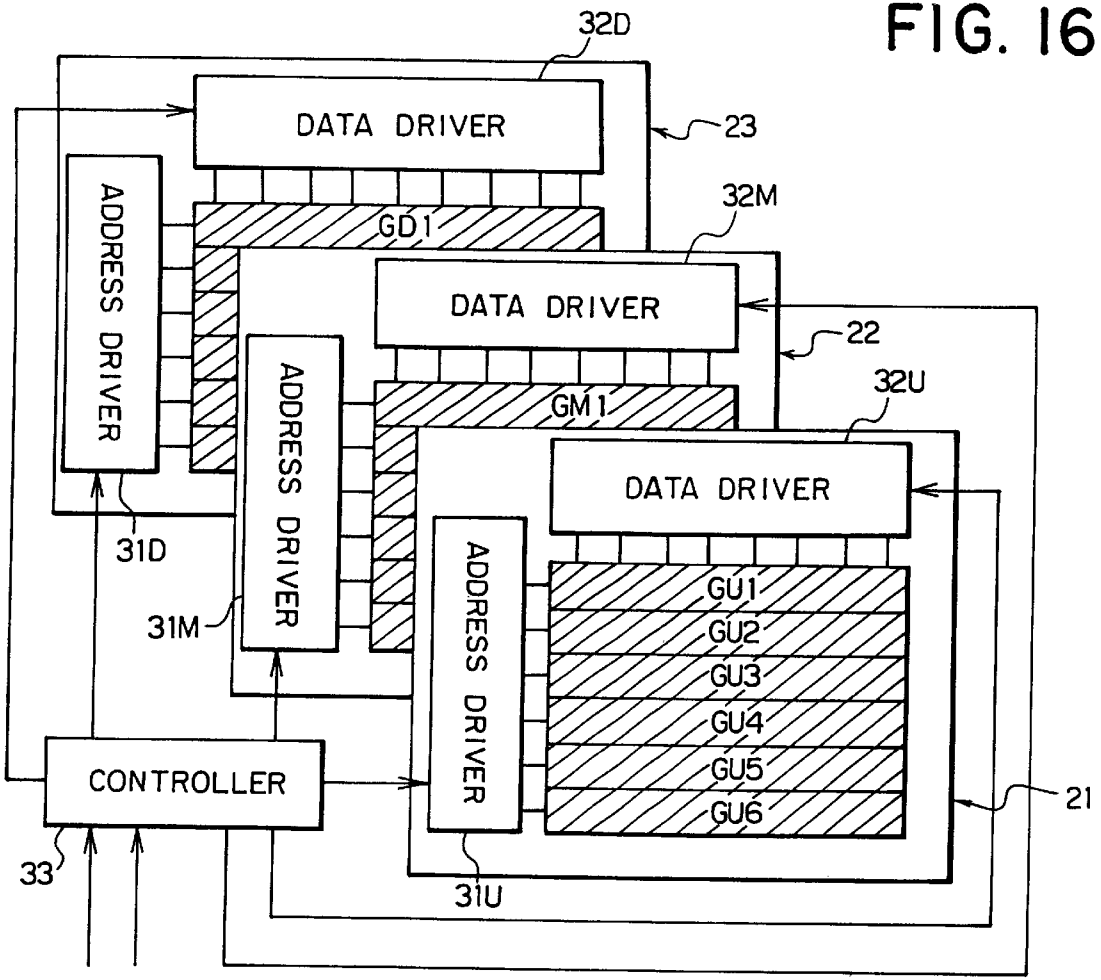
FIG. 16 is a block diagram showing the structure of the LCD according to the present invention.

FIG. 16 is a block diagram showing the structure of an LCD according to the present invention. The LCD shown in FIG. 16 corresponds to the LCD shown in FIG. 4.

The LCD shown in FIG. 16 has a liquid crystal cell 21, a liquid crystal cell 22, and a liquid crystal cell 23. The liquid crystal cell 21 has an address driver 31U and a data driver 32U. The liquid crystal cell 22 has an address driver 31M and a data driver 32M. The liquid crystal cell 23 has an address driver 31D and a data driver 32D. These circuits are integrally formed as poly-Si channel semiconductor films on respective substrates along with respective pixel arrays. Thus, three-layer pixel electrodes are connected to the address lines GUi, GMi, and GDi, respectively so as to form picture elements. Thus, data signals can be supplied to a plurality of pixels that compose picture elements at independent timings for individual pixel electrodes in individual sub-fields.

In this example, the selection timings of the address lines GUi, GMi, and GDi of liquid crystal cells on a plurality of layers are controlled as explained in the second and third embodiments. A controller 33 supplies control signals, including clock signals and data signals, to the address drivers 31U, 31M, and 31D and data drivers 32U, 32M, and 32D. In reality, the controller 33 controls Output Enable OE of the address driving circuits 31U, 31M, and 31D so that one of three pixels on the three layers that compose one picture element is always selected at each of T1, T2, and T3 and that the sum of the elapsed time after the data write point or the sum of the fluctuation of the holding voltage levels after the data write point becomes almost equal in each picture element. To the controller IC 33, those signals can be supplied from the external circuitry such as a CPU of a PC, for example.

FIG. 17A, FIG. 17B, FIG. 17C, FIG. 17D, FIG. 17E, and FIG. 17F are graphs showing examples of profiles of Output Enable (OE) that is supplied from the controller 33 to the address drivers 31U, 31M, and 31D of the liquid crystal cells.

Figures 17A, 17B, 17C, 17D, 17E, 17F:
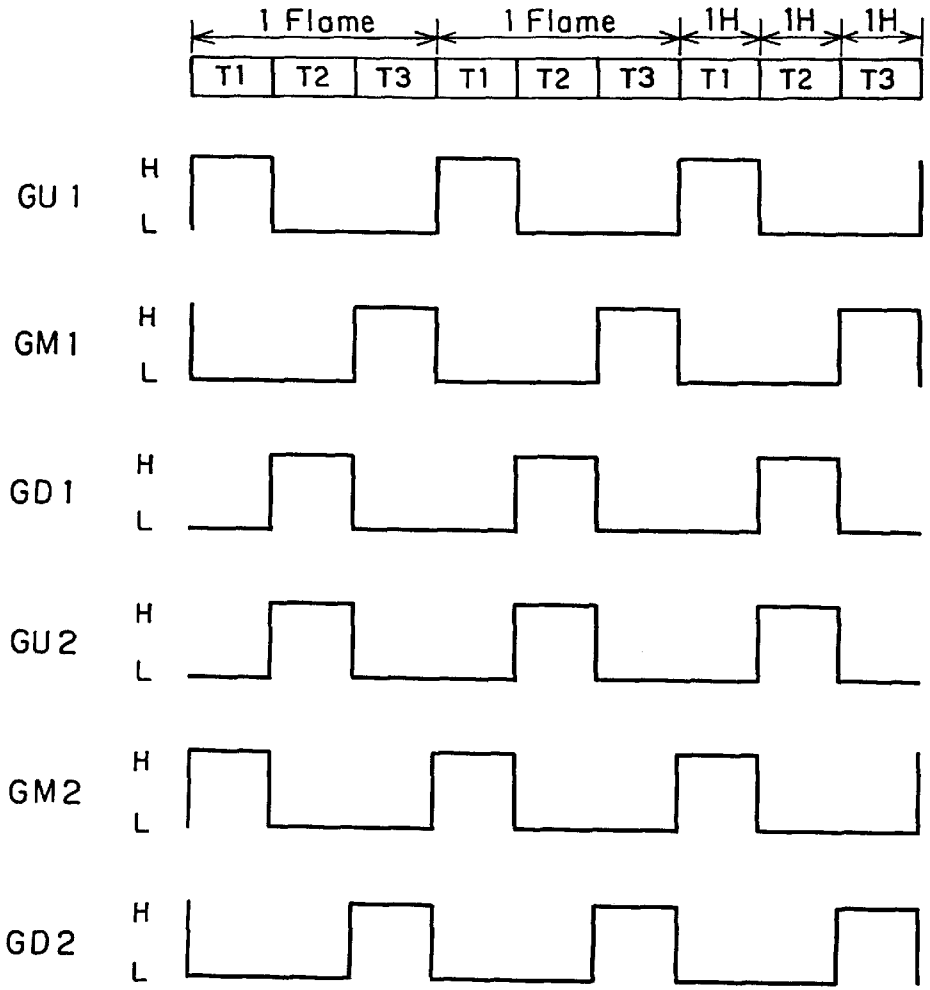
FIG. 17A, FIG. 17B, FIG. 17C, FIG. 17D, FIG. 17E, and FIG. 17F are graphs showing examples of profiles of Output Enable (OE) sent from a controller to an address driver of each liquid crystal cell.

FIG. 17A shows the OE level of the address line GU1. FIG. 17B shows the OE level of the address line GM1. FIG. 17C shows the OE level of the address line GD1. FIG. 17D shows the OE level of the address line GU2. FIG. 17E shows the OE level of the address line GM2. FIG. 17F shows the OE level of the address line GD2.

For example, at t=T1, the controller 33 supplies Output Enable (OE) to relevant address drivers so that the first sub-field of the liquid crystal cell 21 (namely, the address lines GU1, GU4, and GU(3k−2)), the second sub-field of the liquid crystal cell 22 (namely, the address lines GM2, GM5, and GM(3k−1)), and the third sub-field of the liquid crystal cell 23 (namely, the address lines GD3, GD6, and GD(3k)) are selected. In FIGS. 17A to 17F, H and L represent high level and low level, respectively.

For example, at t=T2, the controller 33 supplies Output Enable (OE) to relevant address drivers so that the first sub-field of the liquid crystal cell 23 (namely, the address lines GD1, GD4, and GD(3k−2)), the second sub-field of the liquid crystal cell 21 (namely, the address lines GU2, GU5, and GU(3k−1)), and the third sub-field of the liquid crystal cell 22 (namely, the address lines GM3, GM6, and GM(3k)) are selected.

Likewise, at t=T3, the controller 33 supplies Output Enable (OE) to relevant address drivers so that the first sub-field of the liquid crystal cell 22 (namely, the address lines GM1, GM4, and GM(3k−2)), the second sub-field of the liquid crystal cell 23 (namely, the address lines GD2, GD5, and GD(3k−1)), and the third sub-field of the liquid crystal cell 21 (namely, the address lines GU3, GU6, and G(3k)) are selected.

In the LCD according to the present invention, a plurality of pixels that compose picture elements can be selected and driven on a plurality of liquid crystal cells having pixels arranged in a matrix shape having a plurality of sub-fields so as to compensate the brightness difference between picture elements in different sub-fields.

In other words, the LCD according to the present invention has at least a means for selecting and driving pixels of a plurality of liquid crystal cells that compose picture elements in each sub-field so as to compensate the brightness difference between picture elements in different sub-fields. Thus, the picture quality can be improved without an increase of the power consumption. The selection order of the address lines GUi, GMi, and GDi of each layer is controlled so that one of three pixels that compose one picture element is always selected at each time point of T1, T2, and T3 and that the sum of the elapsed time after the data write point or the sum of the fluctuation of the holding voltage after the data write point becomes almost the same in the entire picture element. Thus, the brightness difference between picture elements in different sub-fields is compensated in each picture element. Consequently, the brightness state shown in FIG. 12 is accomplished.

In this embodiment, the controller 33 controls the address drivers 31U, 31M, and 31D of the liquid crystal cells so as to drive the LCD by the above-described driving method. However, as long as the selection order of the address lines GUi, GMi, and GDi of each layer is controlled so that one of three pixels that compose one picture element is always selected at each time point of T1, T2, and T3 and that the sum of the elapsed time after the data write point or the sum of the fluctuation of the holding voltage after the data write point becomes almost the same in the entire picture element, another structure may be used.

(Fifth Embodiment)

Figure 18:
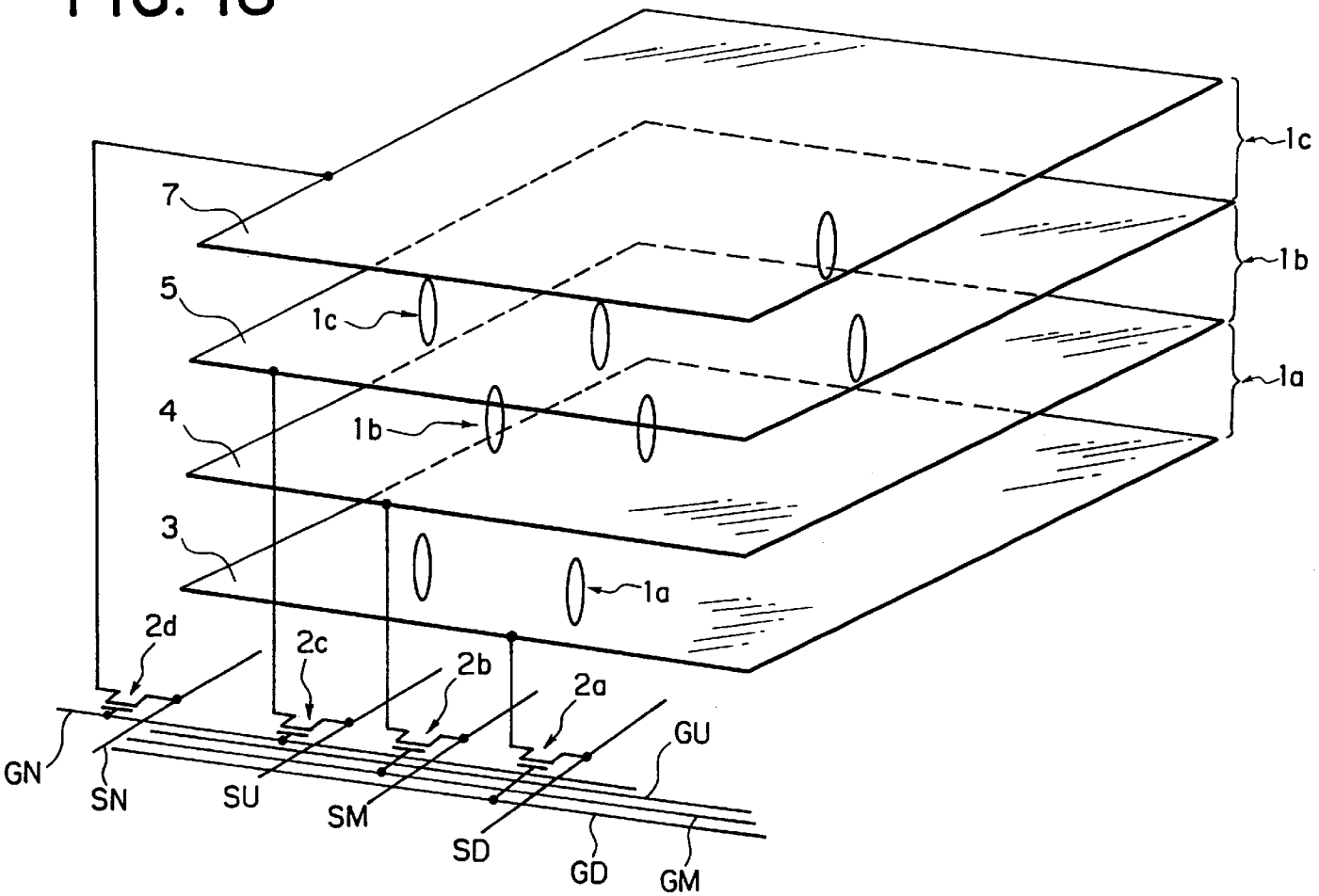
FIG. 18 is a schematic diagram showing another example of the structure of the LCD according to the present invention.
Figure 19:
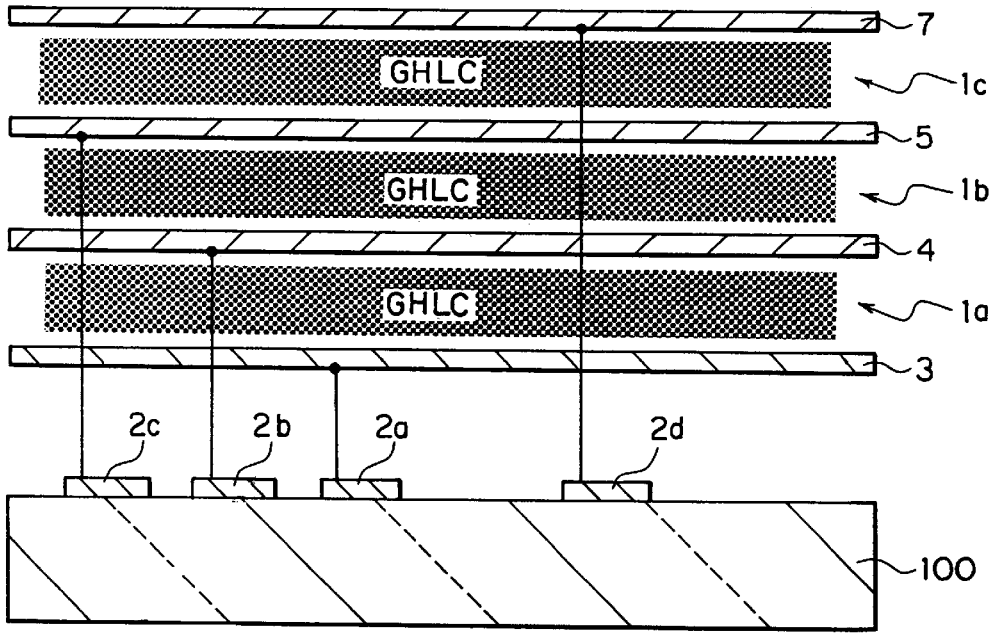
FIG. 19 is a sectional view showing the structure of the LCD according to the present invention shown in FIG. 18.
Figure 20:
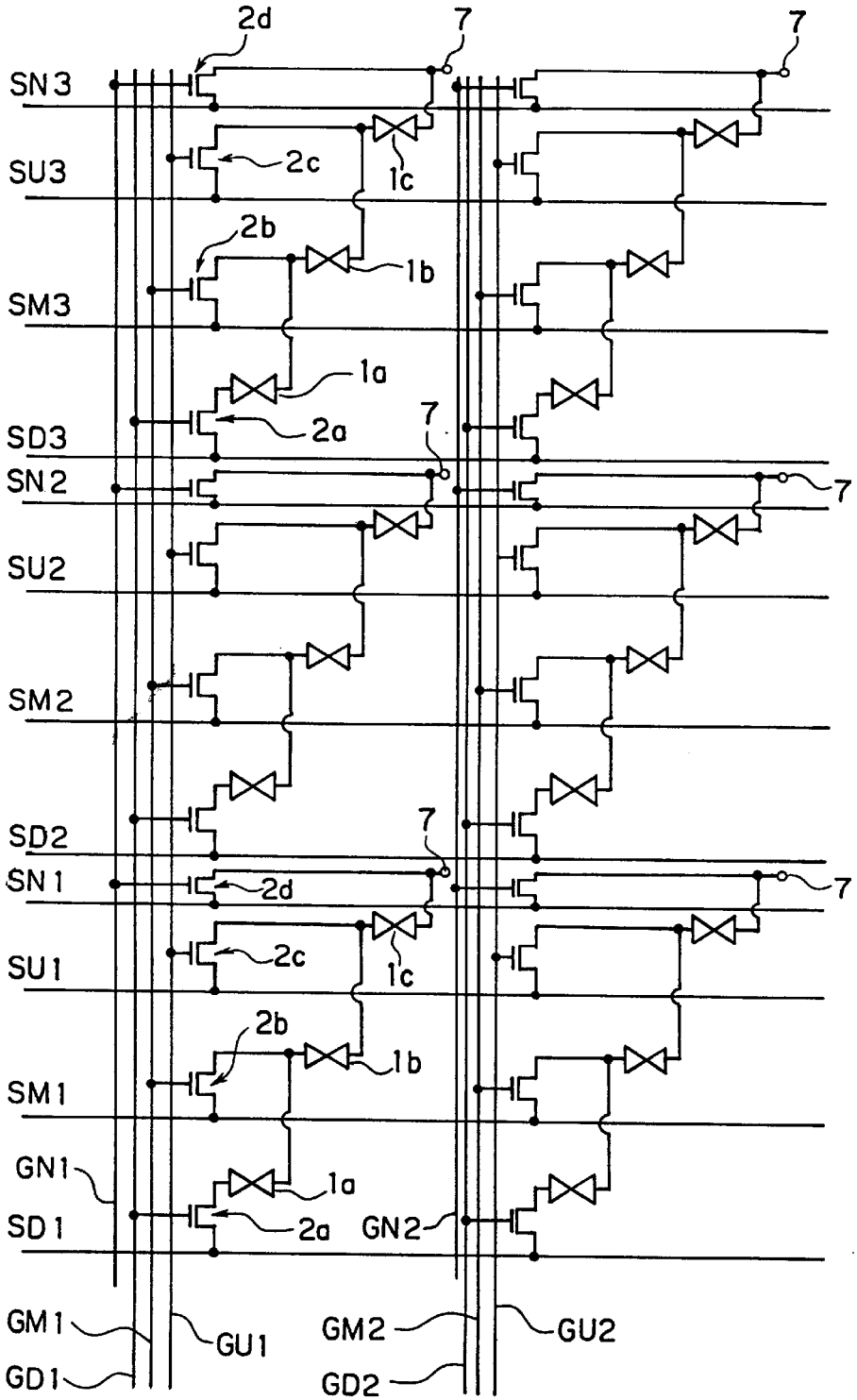
FIG. 20 is a schematic diagram showing an equivalent circuit of the LCD according to the present invention shown in FIG. 18 and FIG. 19.

FIG. 18 is a schematic diagram showing another example of the structure of the LCD according to the present invention. FIG. 19 is a sectional view showing the structure of the LCD shown in FIG. 18. FIG. 20 is a schematic diagram showing an equivalent circuit of the LCD shown in FIG. 19. For simplicity, in FIG. 18, FIG. 19, and FIG. 20, similar portions to those of the above-described embodiments are denoted by similar reference numerals and their description will be omitted. FIG. 18, FIG. 19, and FIG. 20 show the structure of picture elements.

TFTs connected to data lines (SN1, SN2, SN3, and so forth) control transparent pixel electrodes 7. Although these TFTs and data lines are illustrated as a plane circuit in the equivalent circuit shown in FIG. 20, they are actually stacked as layers. GNi represents address lines that supply address signals to relevant switching elements of pixels on individual layers.

Referring to FIG. 19, in addition to TFTs 2*a*, 2*b*, and 2*c*, a TFT 2*d* are formed on an array substrate 100. An opposite substrate (not shown) is disposed above a liquid crystal layer 1*c*. A transparent pixel electrode 7 is disposed on the opposite substrate. The pixel electrode 7 is disposed for each pixel as with other pixel electrodes.

The pixel electrode 7 is electrically connected to the TFT 2*d*. In other words, address signals are supplied from at least an address driver (not shown) to the gate electrodes of individual TFTs through the address lines GDi, GMi, GUi, and GNi. In addition, data signals are supplied from at least a data driver (not shown) to the drain electrodes of individual TFTs through the data lines S (SDi, SMi, SUi, and SNi) (in the case that the TFTs are of n-channel type).

The structure of the LCD according to the present invention shown in FIG. 18, FIG. 19, and FIG. 20 is basically the same as that shown in FIGS. 1 to 6. However, in the example shown in FIG. 18, FIG. 19, and FIG. 20, the four TFTs 2*a*, 2*b*, 2*c*, and 2*d* are disposed for each pixel. Thus, the individual liquid crystal layers 1*a*, 1*b*, and 1*c* that compose pixels can be independently driven.

With the LCD shown in FIGS. 1 to 6, in the case that a voltage Vb is applied to only the liquid crystal layer 1*b*, when the TFT 2*a* is turned off, a voltage Va held in the liquid crystal layer 1*a* does not vary. However, since the voltage level of the counter electrode 6 is constant, a voltage Vc held in the liquid crystal layer 1*c* fluctuates. The fluctuation of the voltage Vc held in the pixel may cause the picture quality to deteriorate (hereinafter this situation is referred to as "deterioration of picture quality due to voltage fluctuation").

In the LCD according to the fifth embodiment, each pixel has four TFTs 2*a,* 2*b,* 2*c,* and 2*d.* Thus, the liquid crystal layers 1*a,* 1*b,* and 1*c* can be fully independently driven. Thus, even if the voltage Vb is applied to only the liquid crystal layer 1*b,* when the TFT 2*a* is turned off, the voltage Va held in the liquid crystal layer 1*a* does not fluctuate. In addition, when the TFT 2*d* is turned off, the voltage Vc held in the liquid crystal layer 1*c* does not fluctuate. Thus, the fluctuation of the voltage Vc does not cause the picture quality to deteriorate. In other words, the structure of the LCD according to the fifth embodiment allows the picture quality to further improve.

Figure 21:
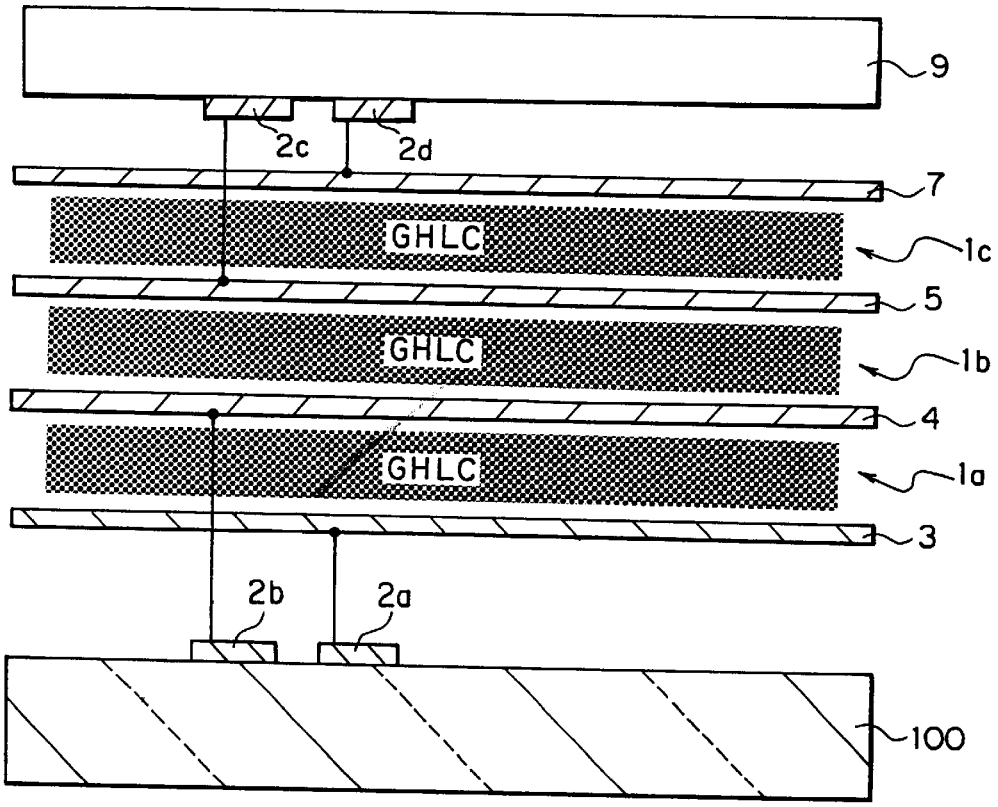
FIG. 21 is a sectional view showing another example of the structure of the LCD according to the present invention.

FIG. 21 is a sectional view showing another example of the structure of the LCD according to the present invention. As with the LCD shown in FIG. 18, in the LCD shown in FIG. 21, each pixel has four TFTs 2*a,* 2*b,* 2*c,* and 2*d.* Thus, liquid crystal layers 1*a,* 1*b,* and 1*c* can be fully independently driven. For simplicity, in FIG. 21, similar portions to those shown in FIG. 18 are denoted by similar reference numerals and their description will be omitted.

TFTs 2*a* and 2*b* are formed on an array substrate 100. An opposite substrate 9 is disposed above the liquid crystal layer 1*c.* TFTs 2*c* and 2*d* are formed on the opposite substrate 9.

The TFT 2*a* and a reflective electrode 3 are electrically connected. The TFT 2*b* and a pixel electrode 4 are electrically connected. The TFT 2*c* and a pixel electrode 5 are electrically connected. The TFT 2*d* and a pixel electrode 7 are electrically connected. In other words, address signals are supplied from an address driver (not shown) to the gate electrodes of the individual TFTs through the address lines GDi, GMi, GUi, and GNi. In addition, data signals are supplied from a data signal driving circuit (not shown) to the drain electrodes of the individual TFTs through the data lines SDi, SMi, SUi, and SNi.

The structure of the LCD shown in FIG. 21 is basically the same as the structure of the LCD shown in FIGS. 18 to 20. However, the LCD shown in FIG. 21 is different from the LCD shown in FIGS. 18 to 20 in that the TFTs 2*c* and 2*d* are formed on the opposite substrate 9.

In an LCD having pixel electrodes interposed with liquid crystal layers as with a tri-layer Guest-Host LCD, establishing electrical connections of pixel electrodes are an engineering problem which decreases a productivity. Such interconnections are performed with plated pillars composed of a metal such as copper. However, currently, it is difficult to improve the productivity of the forming process of plated pillars.

However, in the LCD of the present invention shown in FIG. 21, the number of plated pillars can be decreased in comparison with that of the LCD shown in FIG. 18, FIG. 19, and FIG. 20. Moreover, in the LCD shown in FIG. 21, the height of each plated pillar can be decreased. Thus, the productivity of the LCD can be improved. In addition, the reliability of inter-layer connections can be improved.

(Sixth Embodiment)

Figure 22:
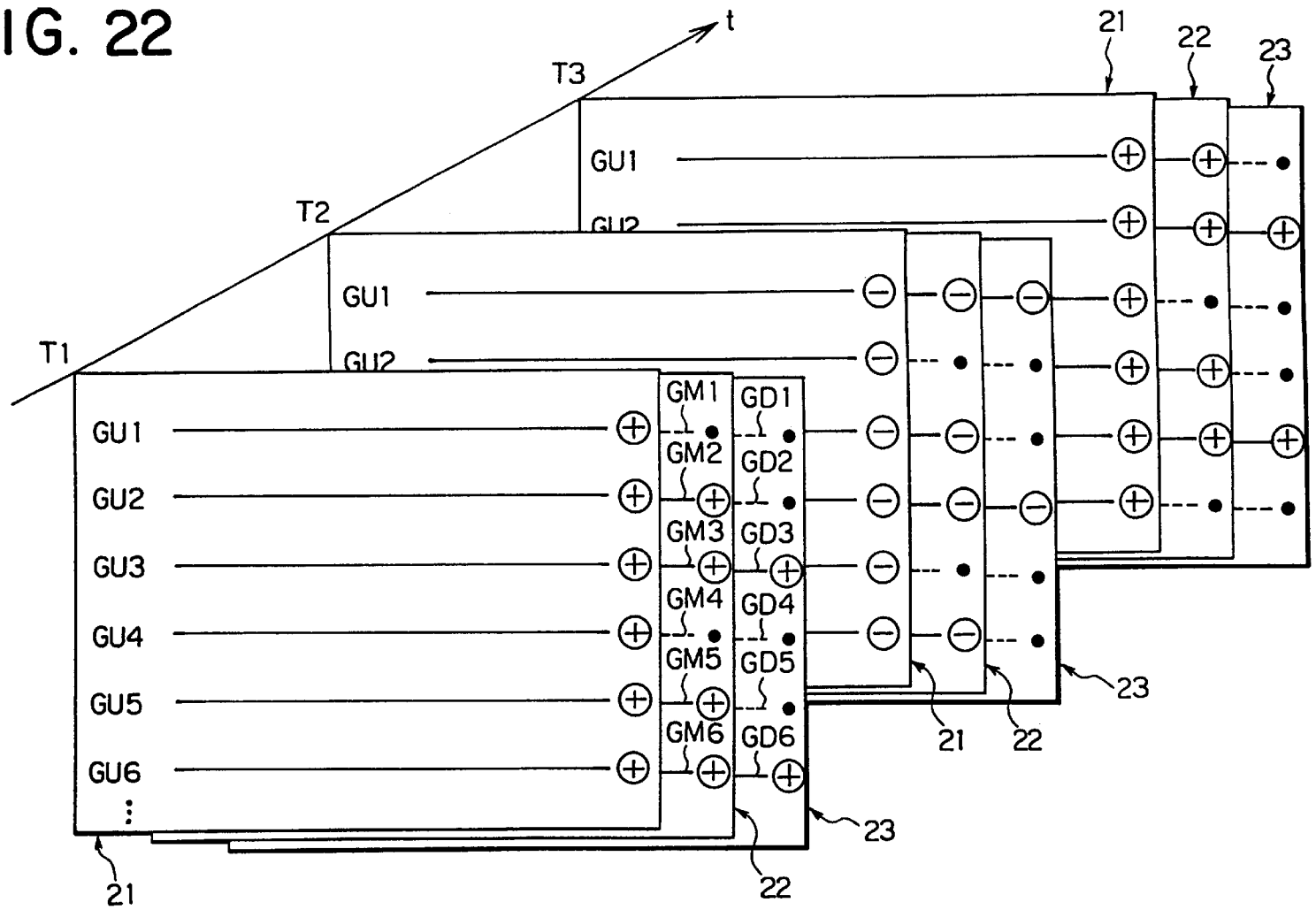
FIG. 22 is a schematic diagram showing another example of the driving method of the LCD according to the present invention.
Figure 23:
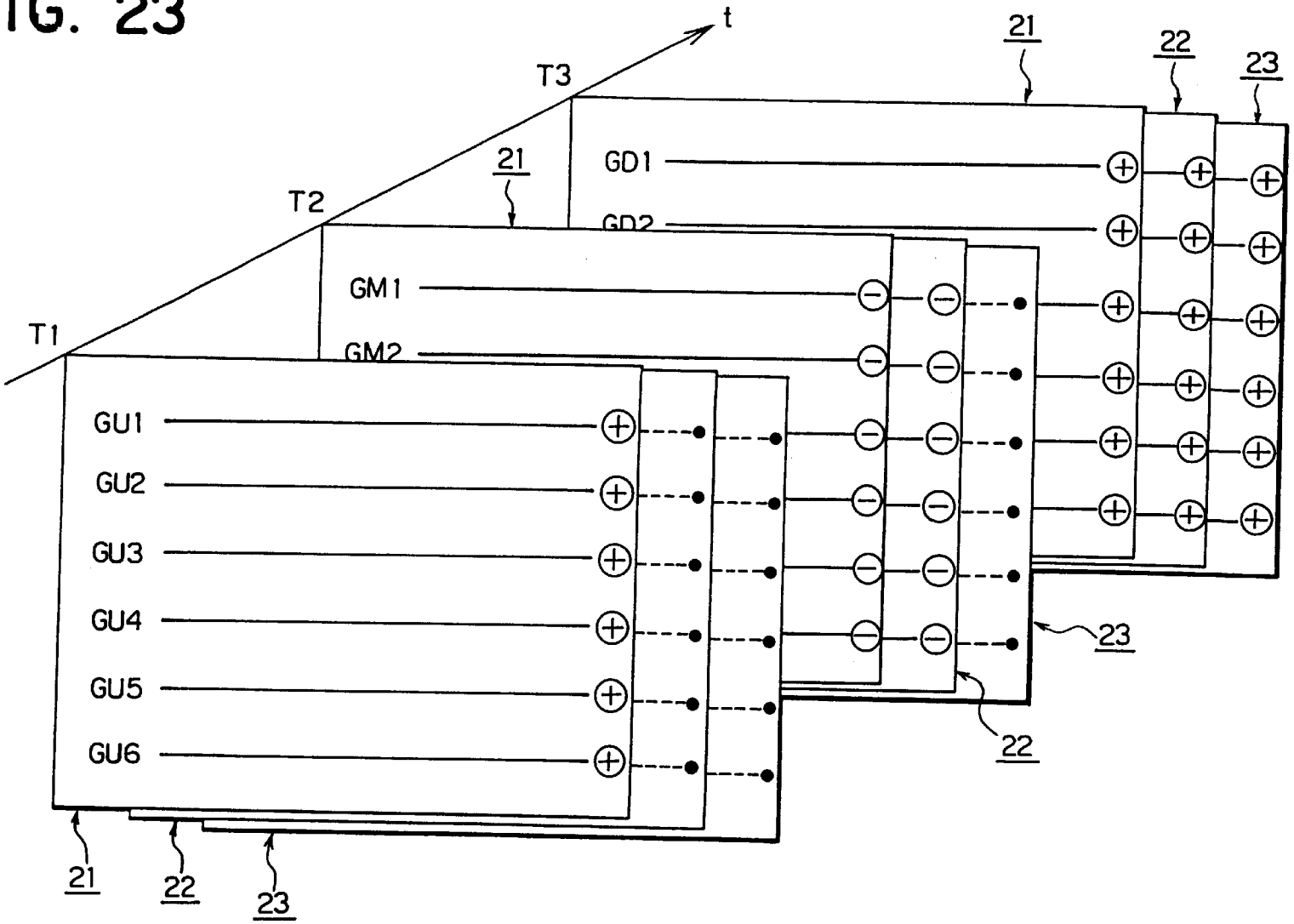
FIG. 23 is a schematic diagram showing another example of the driving method of the LCD according to the present invention.

FIG. 22 and FIG. 23 are schematic diagrams for explaining another example of the driving method for the LCD according to the present invention as a sixth embodiment. In the example shown in sixth embodiment, the multi-field driving method will be described. However, the LCD according to the present invention can be driven by the normal driving method.

In the examples shown in FIG. 22 and FIG. 23, a display screen is divided into three sub-fields and driven. In other words, a matrix of pixels that compose the display screen is divided into three sub-matrixes.

The LCD according to the present invention has at least a means for selecting and driving each pixel of a plurality of stacked liquid crystal cells in each sub-field so as to compensate the brightness difference between picture elements in different sub-fields. A possible form of the selecting and driving means is a driver IC. Thus, an LCD with low power consumption can be accomplished without a deterioration of picture quality. Moreover, in the LCD shown in FIGS. 1 to 6, the deterioration of picture quality due to voltage fluctuation can be suppressed. For simplicity, in FIG. 22 and FIG. 23, similar portions to those in FIGS. 1 to 6 are denoted by similar reference numerals and their description will be omitted.

In the example shown in FIG. 22, for example at t=T1, the first sub-field of the liquid crystal cell 21 (namely, the address lines GU1, GU2, GU3, GU4, GU5, and GU6), the first sub-field of the liquid crystal cell 22 (namely, the address lines GM2, GM3, GM5, and GM6), and the first sub-field of the liquid crystal cell 23 (namely, address lines GD3 and GD6) are selected with positive polarity.

For example, at t=T2, the second sub-field of the liquid crystal cell 23 (namely, the address lines GD1 and GD4), the second sub-field of the liquid crystal cell 21 (namely, the address lines GU1, GU2, GU3, GU4, GU5, and GU6), and the second sub-field of the liquid crystal cell 22 (namely, the address lines GM1, GM3, GM4, and GM6) are selected with negative polarity.

Likewise, at time t=T3, the third sub-field of the liquid crystal cell 22 (namely, the address lines GM1, GM2, GM4, and GM5), the third sub-field of the liquid crystal cell 23 (namely, the address lines GD2 and GD5), and the third sub-field of the liquid crystal cell 21 (namely, the address lines GU1, GU2, GU3, GU4, GU5, and GU6) are selected with positive polarity.

In the example shown in FIG. 23, for example at t=T1, the first sub-field of the liquid crystal cell 21 (namely, the address lines GU1, GU2, GU3, GU4, GU5, and GU6) are selected with positive polarity.

For example, at t=T2, the second sub-field of the liquid crystal cell 21 (namely, the address lines GU1, GU2, GU3, GU4, GU5, and GU6) and the second sub-field of the liquid crystal cell 22 (namely, the address lines GM1, GM2, GM3, GM4, GM5, and GM6) are selected with negative polarity.

Likewise, at time t=T3, the third sub-field of the liquid crystal cell 22 (namely, the address lines GM1, GM2, GM3, GM4, GM5, and GM6), the third sub-field of the liquid crystal cell 23 (namely, the address lines GD1, GD2, GD3, GD4, GD5, and GD6), and the third sub-field of the liquid crystal cell 21 (namely, the address lines GU1, GU2, GU3, GU4, GU5, and GU6) are selected with positive polarity.

In the above-described driving method shown in FIG. 22 and FIG. 23, when the address lines GMi (GDi) of the liquid crystal cell 22 (or the liquid crystal cell 23) are selected, the address lines GUi of the liquid crystal cell 21 are always selected. Thus, the influence of the driving voltage of a liquid crystal layer to other liquid crystal layers can be suppressed. Consequently, the deterioration of picture quality due to voltage fluctuation does not take place.

However, in the driving method shown in FIG. 22, the selection order of the address lines GUi, GMi, and GDi of each layer is not controlled so that the sum of the elapsed time after the data write point or the sum of the fluctuation of the holding voltage after the data write point becomes almost the same in the entire picture element. Thus, although the brightness difference between picture elements that compose different sub-fields is compensated for each picture element, the brightness difference is not ideally compensated. Consequently, the perfect brightness state as shown in FIG. 12 is not accomplished.

(Seventh Embodiment)

Figure 24A:
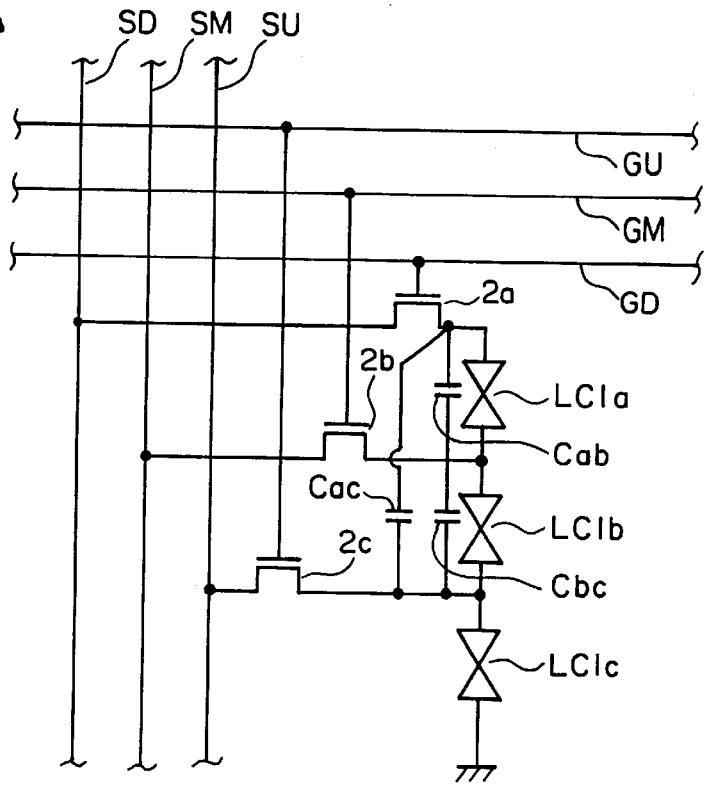
FIG. 24A is a schematic diagram showing an equivalent circuit of the LCD according to the present invention shown in FIG. 1.

FIG. 24A is a schematic diagram showing an equivalent circuit of another example of the structure of an LCD according to the present invention. In the LCD shown in FIG. 24A, the influence of a coupling capacity between a pixel electrode and a plated pillar is considered unlike with the structures of conventional LCDs.

In a stacked TFT-LCD, a TFT and a pixel electrode are connected with a plated pillar composed of copper or another connecting metals (refer to SID '98 DIGEST "Reflective Color LCD Composed of Stacked Films of Encapsulated Liquid Crystal (SFELIC)", pp. 762–765). Such a plated pillar is formed adjacent to a pixel electrode respectively. Thus, a coupling capacity is formed between the pixel electrode and the copper plated pillar. This capacitance is considered in the present invention.

In FIG. 24A, SD, SM, and SU represent data lines; GU, GM, and GD represent gate lines; reference numerals 2*a,* 2*b,* and 2*c* represent TFTs; LC1*a* represents the capacity of the liquid crystal of a liquid crystal layer 1*a;* LC1*b* represents the capacity of the liquid crystal of a liquid crystal layer 1*b;* LC1*c* represents the capacity of the liquid crystal of a liquid crystal layer 1*c;* Cab represents the coupling capacity between a copper plated pillar as the gate line 2*b* and a pixel electrode 3; Cbc represents the coupling capacity between a copper plated pillar as the gate line 2*c* and a pixel electrode 4; and Cac represents the coupling capacity between a copper plated pillar as the gate line 2*c* and the pixel electrode 3.

Figure 24B:
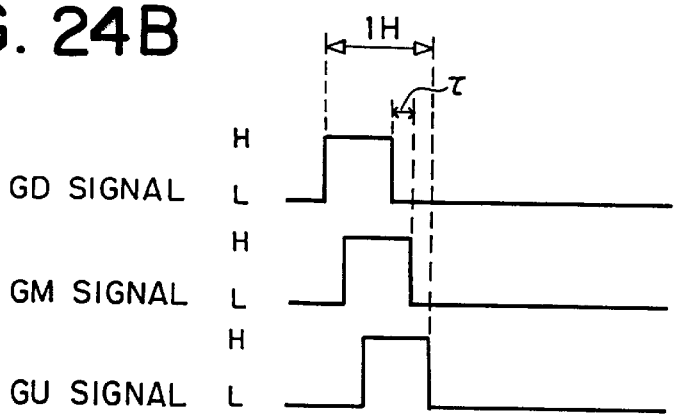
FIG. 24B and FIG. 24C are graphs showing examples of drive waveforms of a tri-layer GH LCD.
Figure 24C:
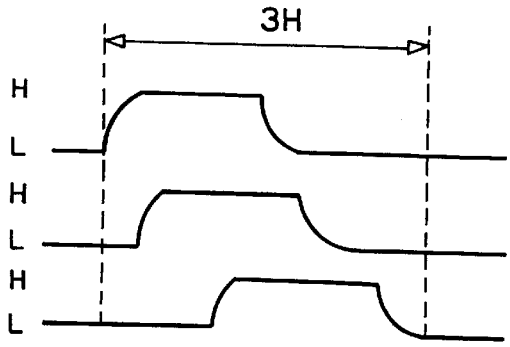

FIG. 24B and FIG. 24C showing examples profiles of driving signal of a tri-layer Guest-Host LCD.

In this case, it is not preferable to simply apply the drive waveforms shown in FIG. 24B to the circuit shown in FIG. 24A. This is because when each of the address lines GD, GM, and GU is turned off, a feed-through voltage takes place in each pixel electrode through the parasitic capacity of a relevant TFT. However, the feed-through voltage varies, according to a level of a data signal for example, in each pixel electrode. Thus, the white balance gets lost and thereby the picture quality deteriorates.

Figure 25A:
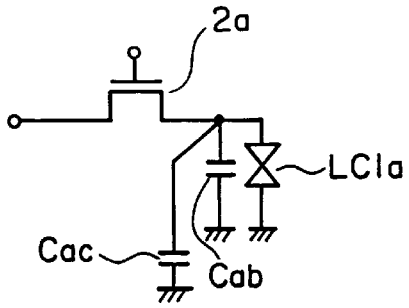
FIG. 25A is a schematic diagram showing an equivalent circuit in the case that a TFT 2*a* of the LCD shown in FIG. 24B is turned off.
Figure 25B:
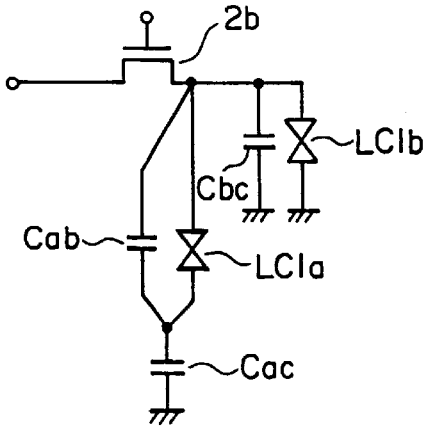
FIG. 25B is a schematic diagram showing an equivalent circuit in the case that a TFT 2*b* of the LCD shown in FIG. 24B is turned off.
Figure 25C:
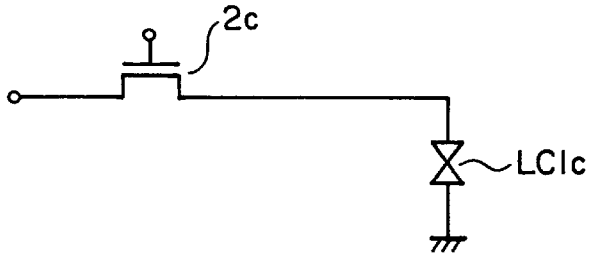
FIG. 25C is a schematic diagram showing an equivalent circuit in the case that a TFT 2*c* of the LCD shown in FIG. 24B is turned off.

FIG. 25A shows an equivalent circuit in the case that the TFT 2*a* is turned off. FIG. 25B shows an equivalent circuit in the case that the TFT 2*b* is turned off. FIG. 25C shows an equivalent circuit in the case that the TFT 2*c* is turned off.

Assuming that the parasitic capacity of each of the TFTs 2*a,* 2*b,* and 2*c* is denoted by Cgs, the feed-through voltage ΔV3 that takes place in the pixel electrode 3, the feed-through voltage ΔV4 that takes place in the pixel electrode 4, and the feed-through voltage ΔV5 that takes place in the pixel electrode 5 are expressed as follows.

$$\Delta V3 = Cgs \times Vg/(Cgs + LC1a + Cab + Cac)$$

$$\Delta V4 = Cgs \times Vg/(Cgs + LC1b + Cbc + ((Cab + LC1a) \times Cac/(Cab + LC1a + Cac)))$$

$$\Delta V5 = Cgs \times Vg/(Cgs + LC1c)$$

where Cgs represents the capacity between the gate and the pixel electrode; and Vg represents the gate voltage. Intensive study by the inventors of the present invention shows that the feed-through voltage varies in each of the liquid crystal layer 1*a,* 1*b,* and 1*c* and thereby causes the white balance to be lost. In addition, the intensive study shows that capacities other than Cgs vary depending on an applied voltage. According to the present invention, such a problem can be solved.

Figure 26:
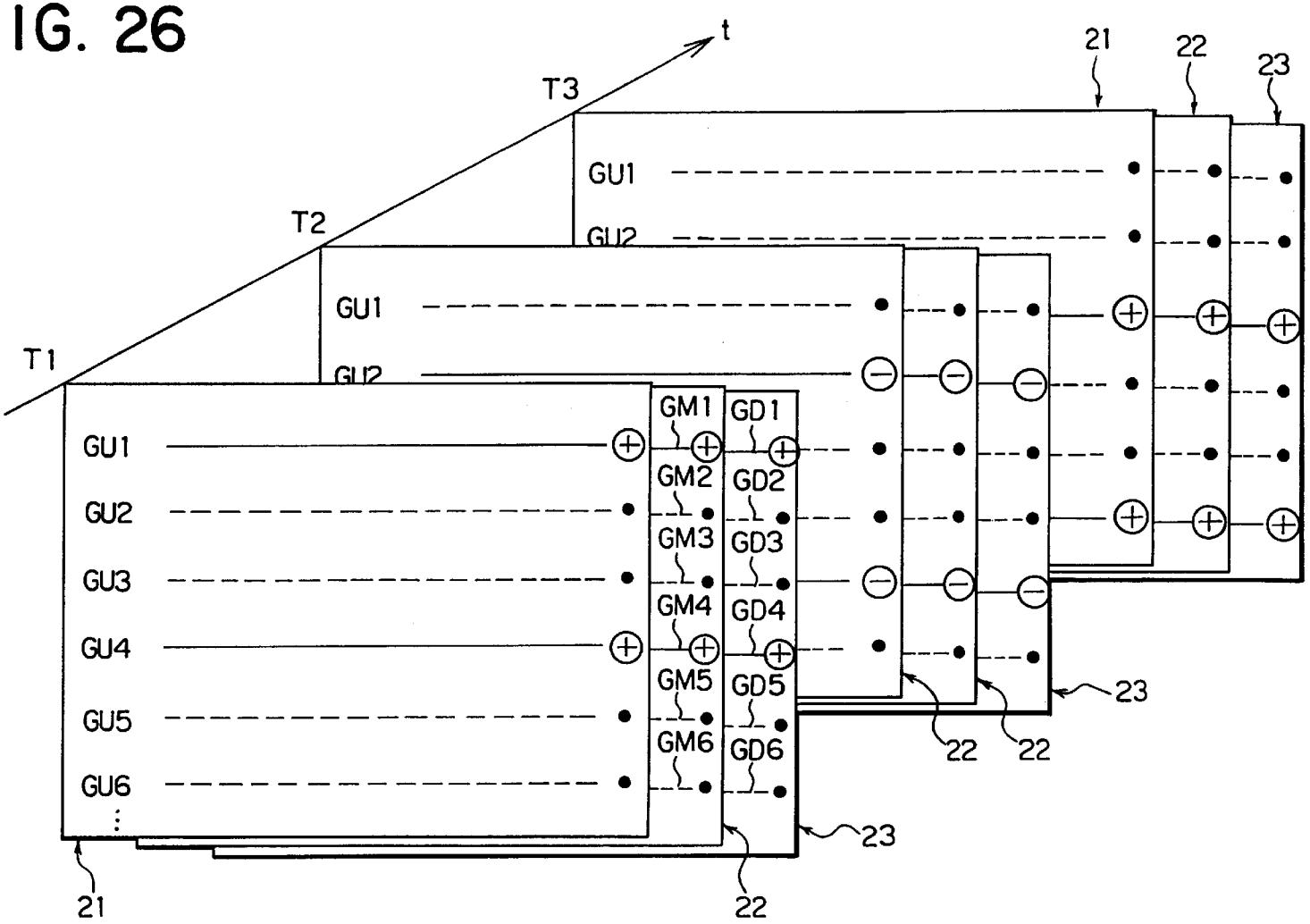
FIG. 26 is a schematic diagram for explaining an example of the driving method of the LCD according to the present invention.

FIG. 26 is a schematic diagram for explaining an example of the driving method for an LCD according to the present invention. In other words, according to the seventh embodiment, the LCD shown in FIG. 1 and FIG. 24A is driven by the multi-field driving method. In the multi-field driving method, the write period can be increased three times the normal driving method. Thus, as shown in FIG. 24C, the rise time and the fall time of gate pulses can be prolonged and dull. In the drive waveforms shown in FIG. 24C, the rising edge and falling edge of each gate pulse are dulled. According to the present invention, such waveforms are accomplished by increasing the resistance R of an address driver. Alternatively, the resistance R of the last switching circuit of the driving circuit may be increased. In the conventional LCD, the resistance R is in the range from around 200-to 1 kΩ. However, in the LCD according to the present invention, the resistance R is in the range from around 400-to 2 kΩ. Although the resistance R depends on the size of the LCD and the number of pixels thereof, when the size of the LCD according to the present invention is the same as the size of the conventional LCD, the resistance R of the LCD according to the present invention is larger than that of the conventional LCD.

In this example, the resistance R is fixed to a high value. Alternatively, the resistance R may be varied in several levels. For example, due to the fact that the color distinguishing characteristics of a still picture is high and that of a movie is low, the value of the resistance R in the state that a still picture is displayed may be different from the value of the resistance R in the state that a movie is displayed.

In such a structure, the feed-through voltage that takes place in each liquid crystal layer can be decreased. Thus, when the LCD according to the present invention is driven by the multi-field driving method, the white balance can be improved and better picture quality can be accomplished.

(Eighth Embodiment)

In the driving method disclosed in Embodiment 1 of Japanese Patent Application No. 7-7969 (refer to FIG. 2A and FIG. 2B of the specification of Japanese Patent Application No. 7-7969), each liquid crystal layer is driven in the floating state. Thus, the voltages of data lines can be decreased. However, in this case, the write period of each liquid crystal layer becomes short. In the related art reference (see FIG. 2B of Japanese Patent Application No. 7-7969), the write period becomes around ⅓ times that of the normal driving method. Thus, in the related art reference, proper data signal voltages cannot be applied to pixel electrodes.

However, according to the present invention, such a problem can be solved. In other words, in the LCD according to the present invention, the voltages of data lines can be decreased by the floating driving method. In addition, the deterioration of the picture quality due to insufficient write period can be suppressed.

Figure 27:
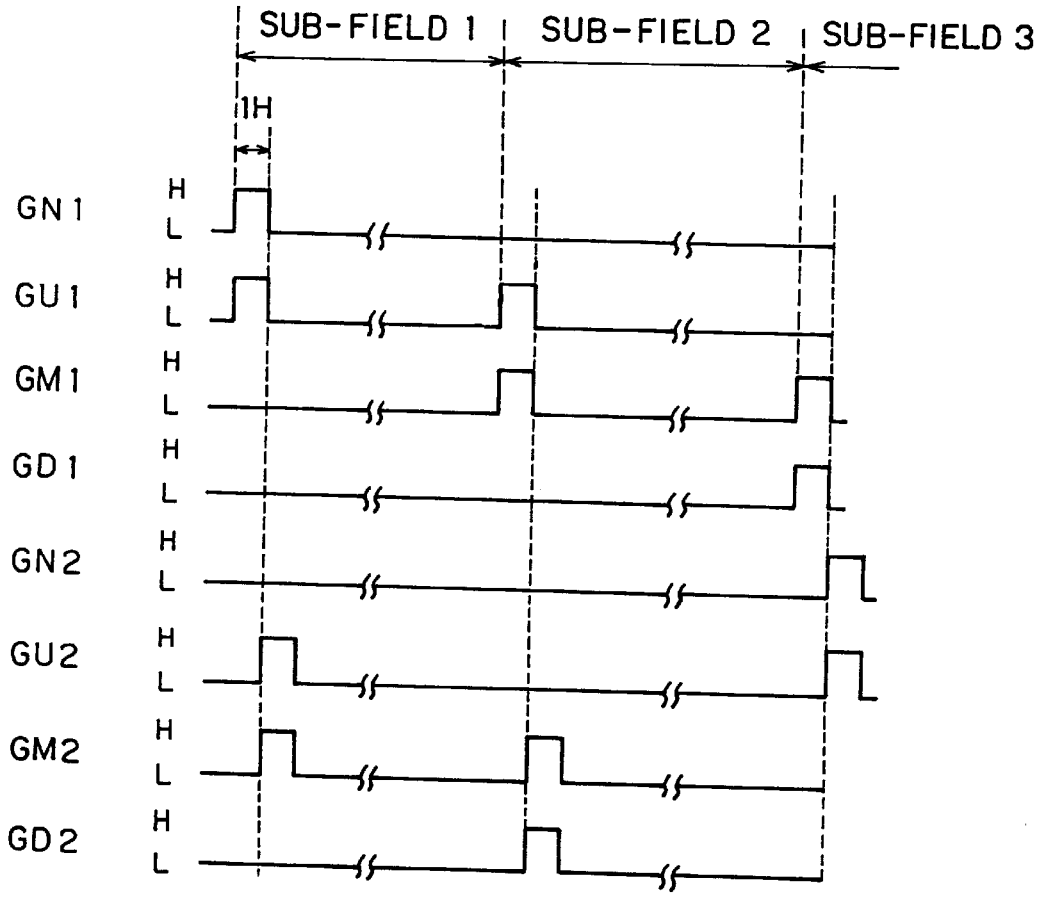
FIG. 27 is a graph showing examples of drive waveforms of address lines of the LCD according to the present invention.

FIG. 27 shows examples of drive waveforms of address lines of the LCD according to the present invention. In the LCD shown in FIG. 20, individual liquid crystal layers are driven with address signals shown in FIG. 27. FIG. 27 shows timings of gate pulses of individual gate lines. In FIG. 27, GNi represent the voltage levels of the gate lines GNi. A data signal is written to the liquid crystal layer 1*b* when the signal levels of GUi and GMi are high. A data signal is written to the liquid crystal layer 1*a* when the signal levels of GMi and GDi are high. While a data signal is written to a particular liquid crystal layer, the signal levels of the other liquid crystal layers are in the floating state.

In other words, in this example, since one frame is composed of sub-fields 1, 2, and 3, a data signal can be written to each liquid crystal layer in 1H period while the LCD is being driven by the floating driving method.

As described above, since both the floating driving method and the multi-field driving method are used at the same time (for each layer), an LCD with low power consumption can be accomplished free from deterioration of picture quality due to insufficient data write operation.

(Ninth Embodiment)

The selection timings of polarities of address lines for driving the LCD according to the present invention are not limited to the above-described timings.

FIG. 28, FIG. 29, FIG. 30, FIG. 31, FIG. 32, FIG. 33, FIG. 34, and FIG. 35 are schematic diagrams for explaining other examples of the driving method for an LCD according to the present invention.

Figure 28:
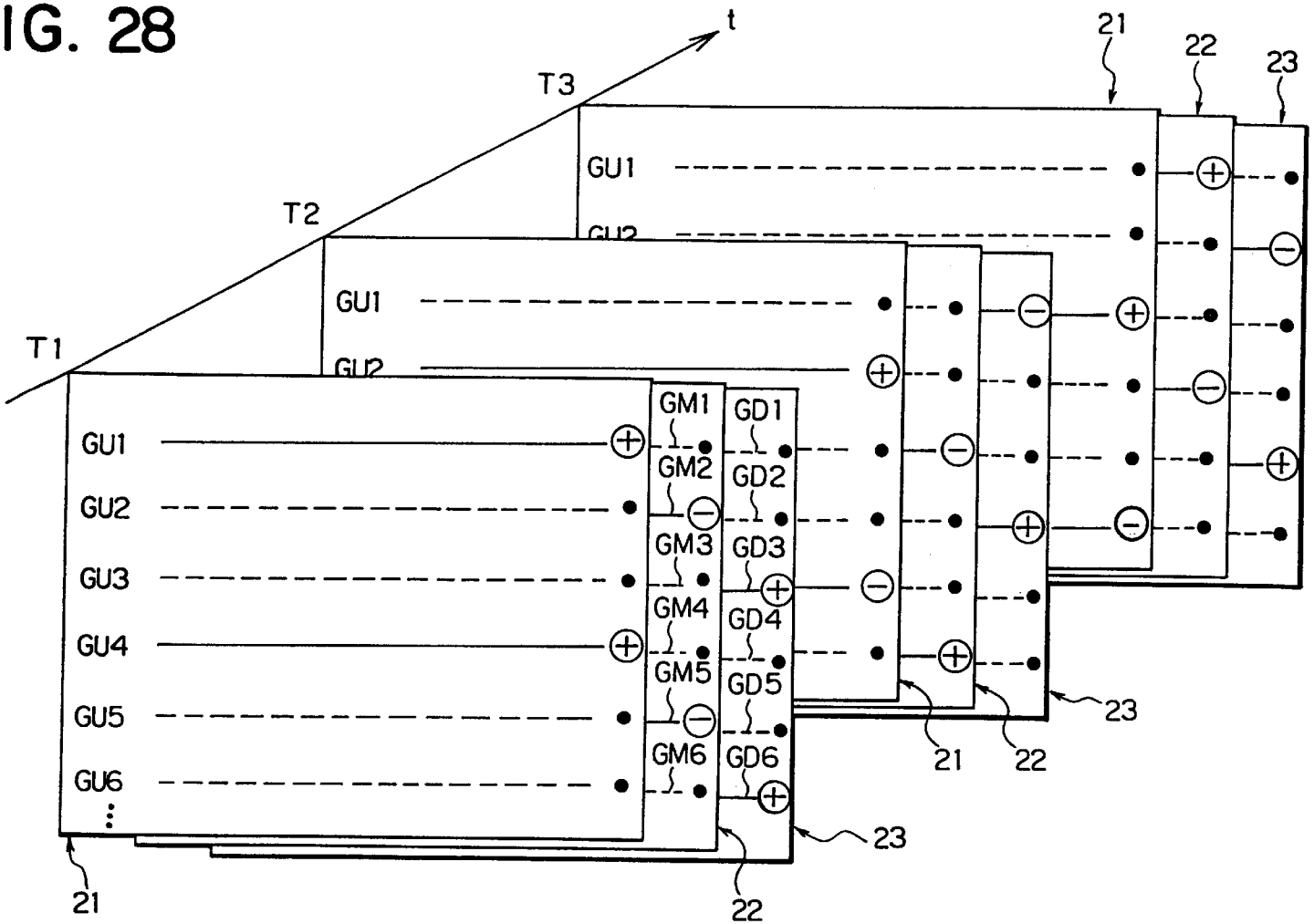
FIG. 28 is a schematic diagram for explaining another example of the driving method of the LCD according to the present invention.

In the driving method shown in FIG. 9, the LCD according to the present invention may be driven with timings shown in FIG. 28. In the driving method shown in FIG. 13, the LCD may be driven with timings shown in FIG. 29. In the driving method shown in FIG. 22, the LCD may be driven with timings shown in FIG. 30. In the driving method shown in FIG. 23, the LCD may be driven with timings shown in FIG. 31. In the driving method shown in FIG. 26, the LCD may be driven with timings shown in FIG. 32. As long as flickering and line disturbance can be prevented, the LCD may be driven with other timings. In the driving methods shown in FIG. 9, FIG. 13, and FIG. 26, the LCD can be driven with timings shown in FIG. 33, FIG. 34, and FIG. 35 of which the polarities of adjacent pixels of the same address line are opposite.

Figure 33:
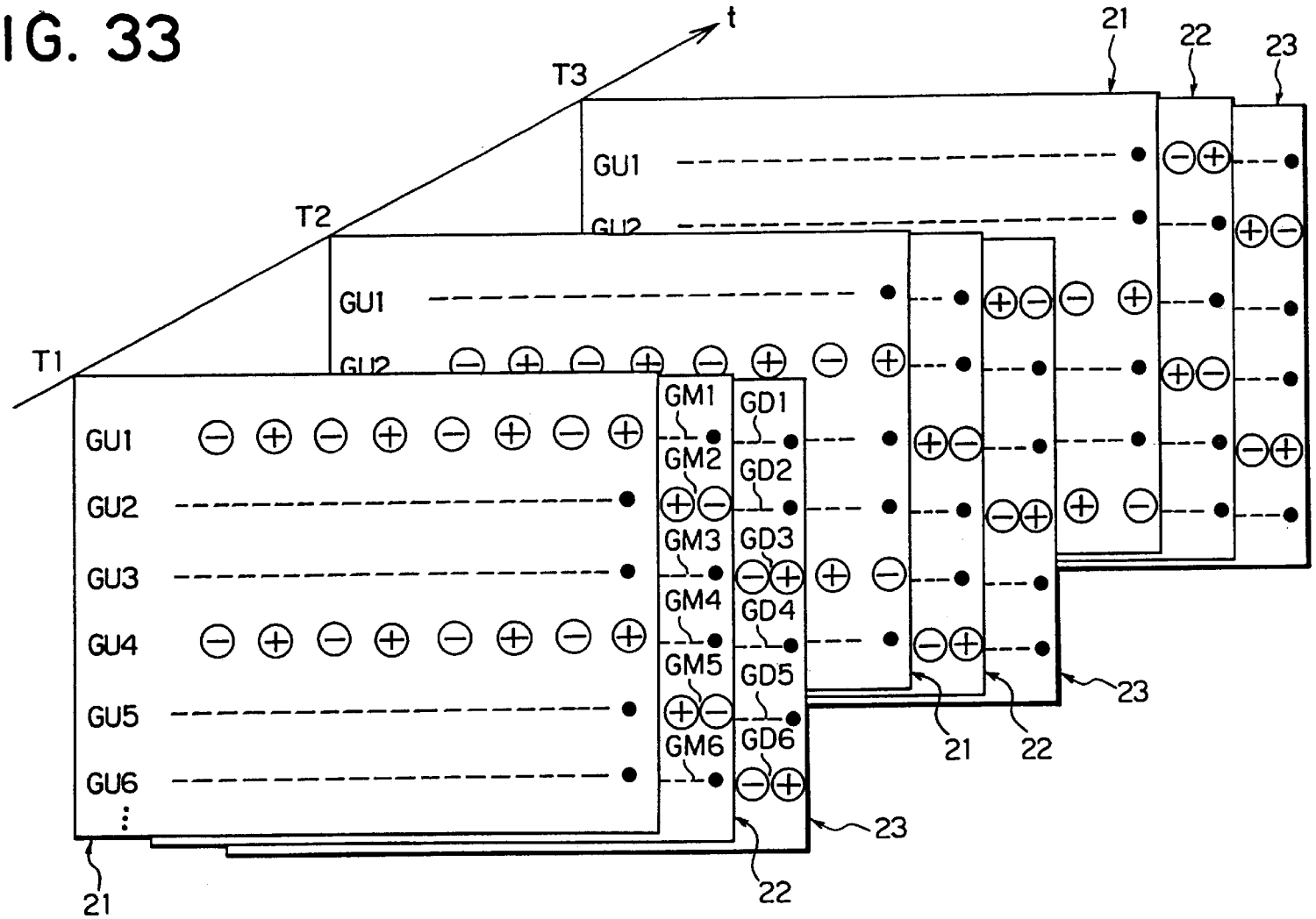
FIG. 33 is a schematic diagram for explaining another example of the driving method of the LCD according to the present invention.
Figure 34:
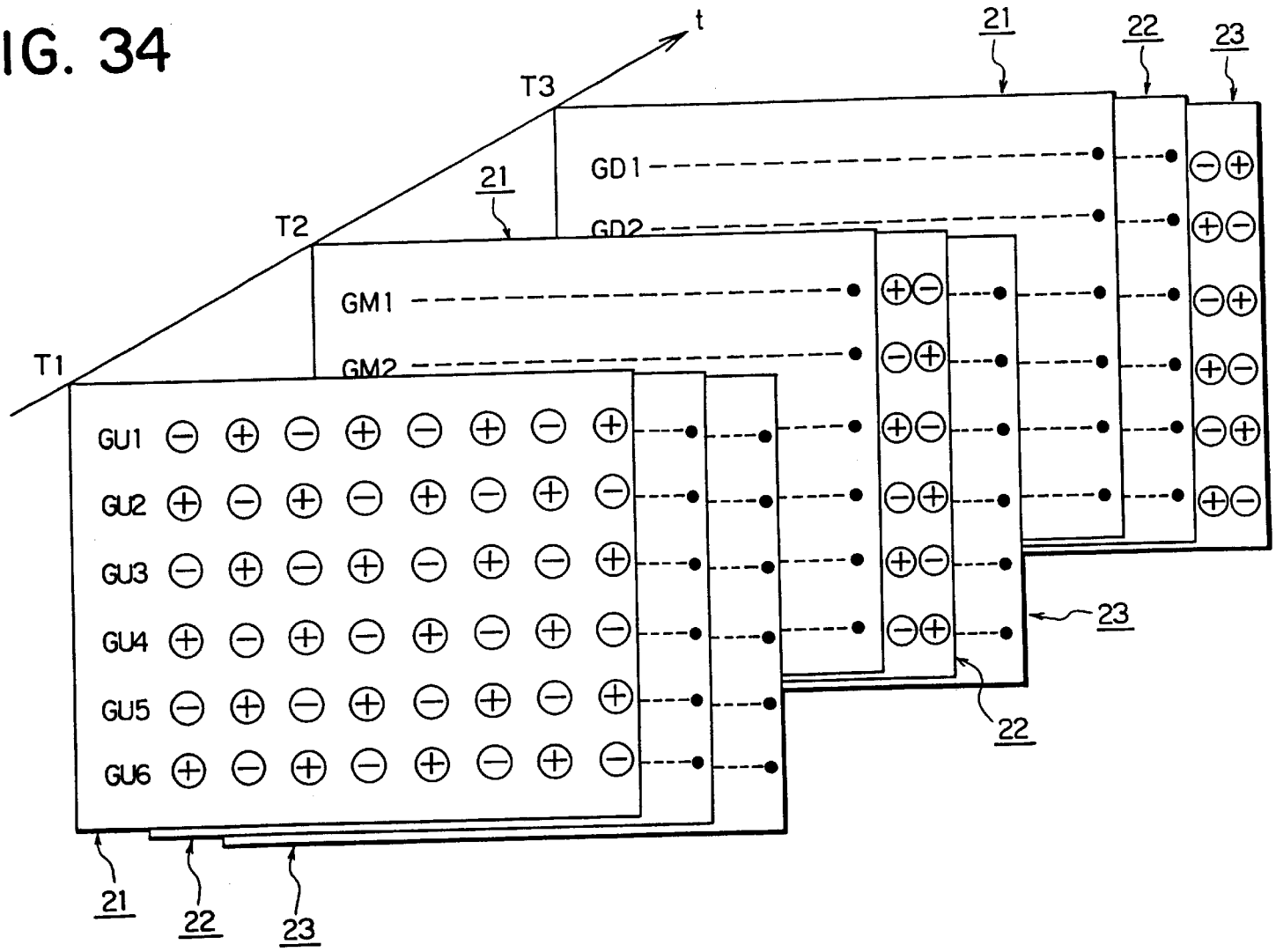
FIG. 34 is a schematic diagram for explaining another example of the driving method of the LCD according to the present invention.
Figure 35:
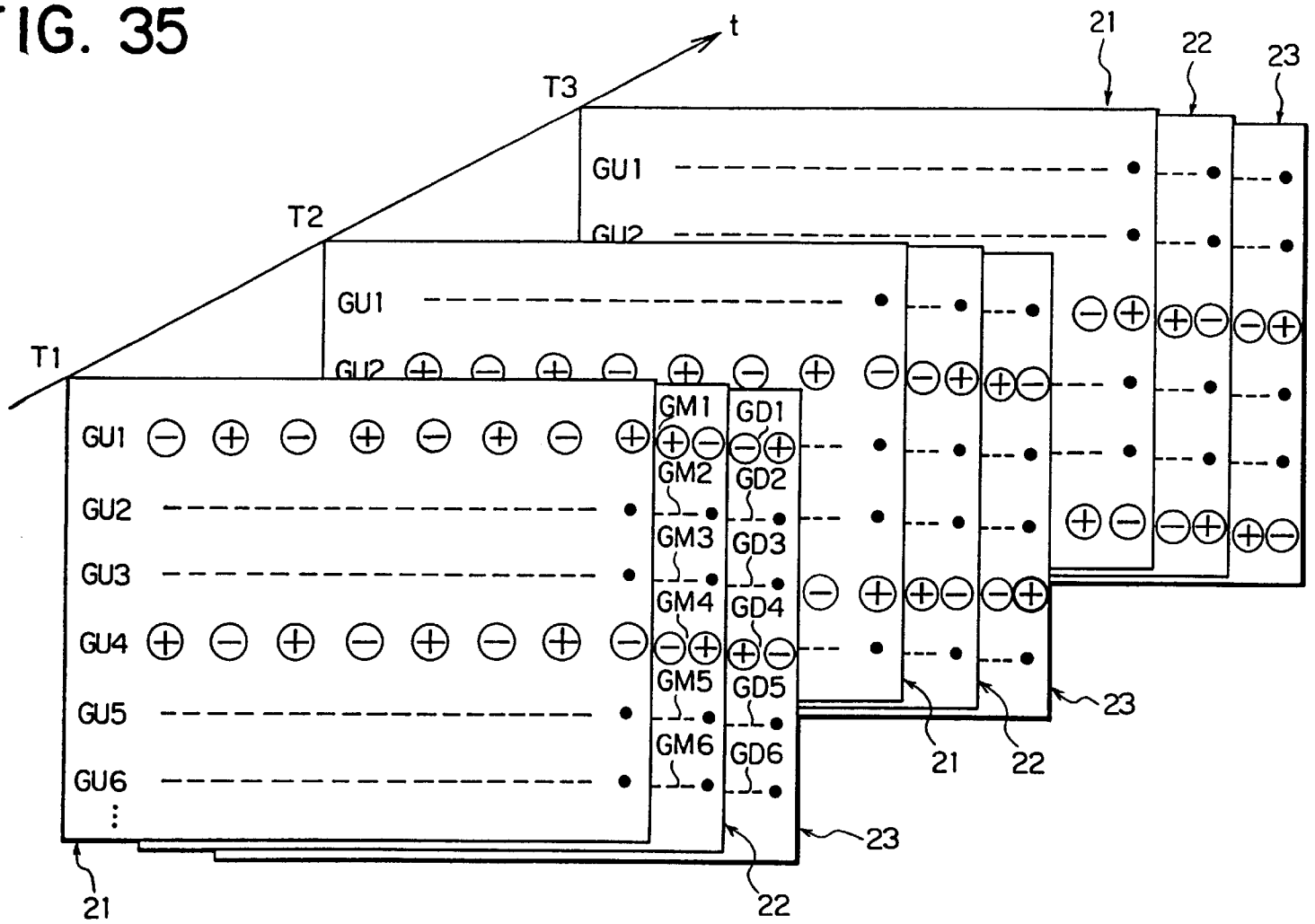
FIG. 35 is a schematic diagram for explaining another example of the driving method of the LCD according to the present invention.

According to the present invention, as the driving method of an LCD, an address line inversion driving method, a dot inversion driving method, an H common inversion driving method, or the like may be used. In this case, timings of polarities of address lines are set corresponding to the driving method for use. In this case, as shown in FIG. 33, polarities of adjacent pixels of the same address line may be different from each other.

Figure 29:
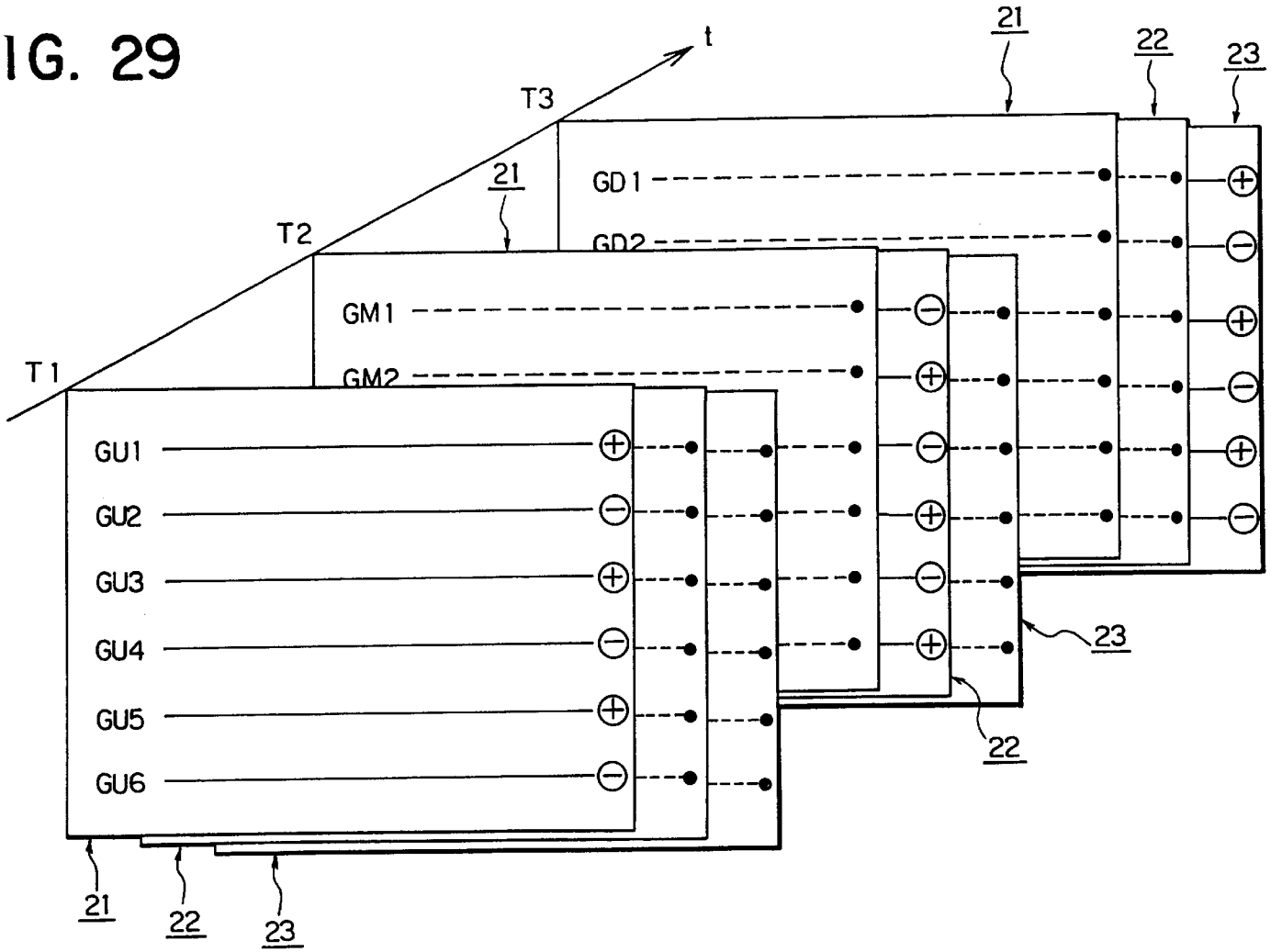
FIG. 29 is a schematic diagram for explaining another example of the driving method of the LCD according to the present invention.

In the driving method shown in FIG. 29, each liquid crystal layer is driven in each sub-field. Thus, when the contrast ratio of each liquid crystal layer is different from each other, a picture will flicker on the LCD.

In the LCD shown in FIG. 19, experimental results show that when the contrast ratio of the LCD is 1, the contrast ratio of the cyan layer is 0.51; the contrast ratio of the magenta layer is 0.46; and the contrast ratio of the yellow layer is 0.03. Thus, when each liquid crystal layer is driven in each sub-field, each liquid crystal layer is selected and driven corresponding to the contrast ratio of each liquid crystal layer. For example, a frame picture is divided into 100 sub-fields so that the number of sub-fields for driving the cyan layer is assigned 51, the number of sub-fields for driving the yellow layer is assigned 46, and the number of sub-fields for driving the yellow layer is assigned 3. More preferably, a frame picture is divided into seven sub-fields so that the number of sub-fields for driving the cyan layer is assigned 3, the number of sub-fields for driving the magenta layer is assigned 3, and the number of sub-fields for driving the yellow layer is assigned 1.

Figure 30:
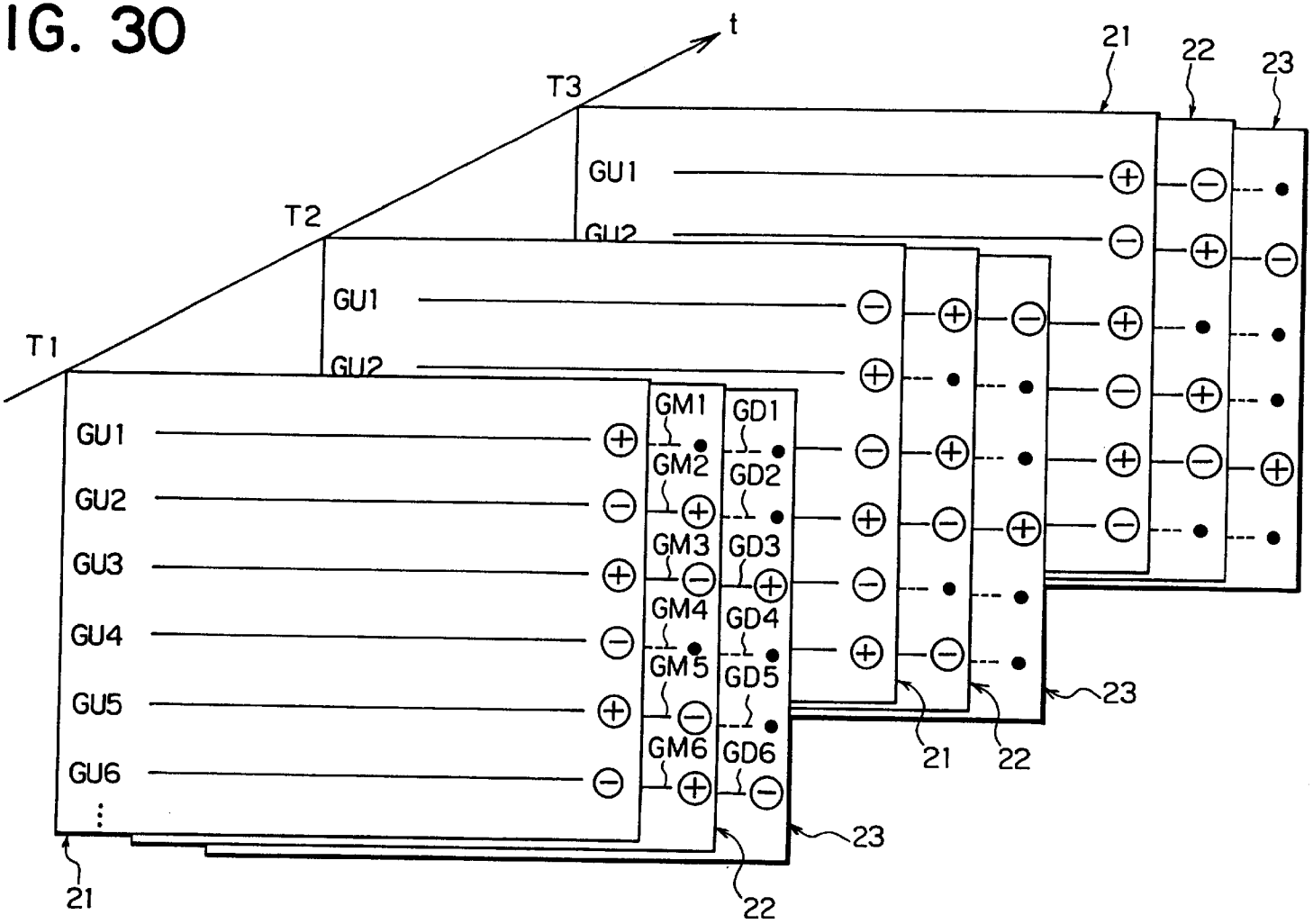
FIG. 30 is a schematic diagram for explaining another example of the driving method of the LCD according to the present invention.
Figure 31:
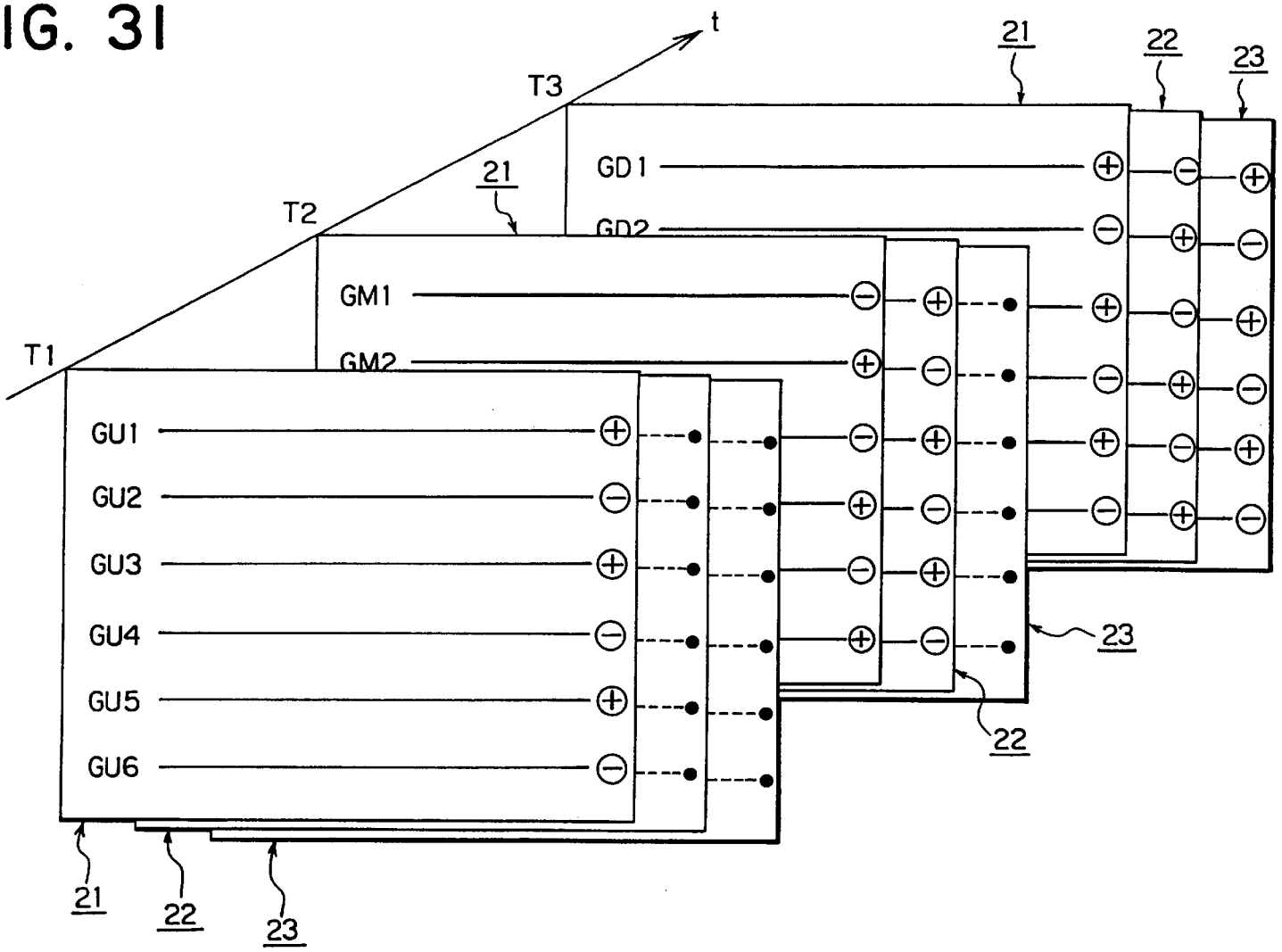
FIG. 31 is a schematic diagram for explaining another example of the driving method of the LCD according to the present invention.
Figure 32:
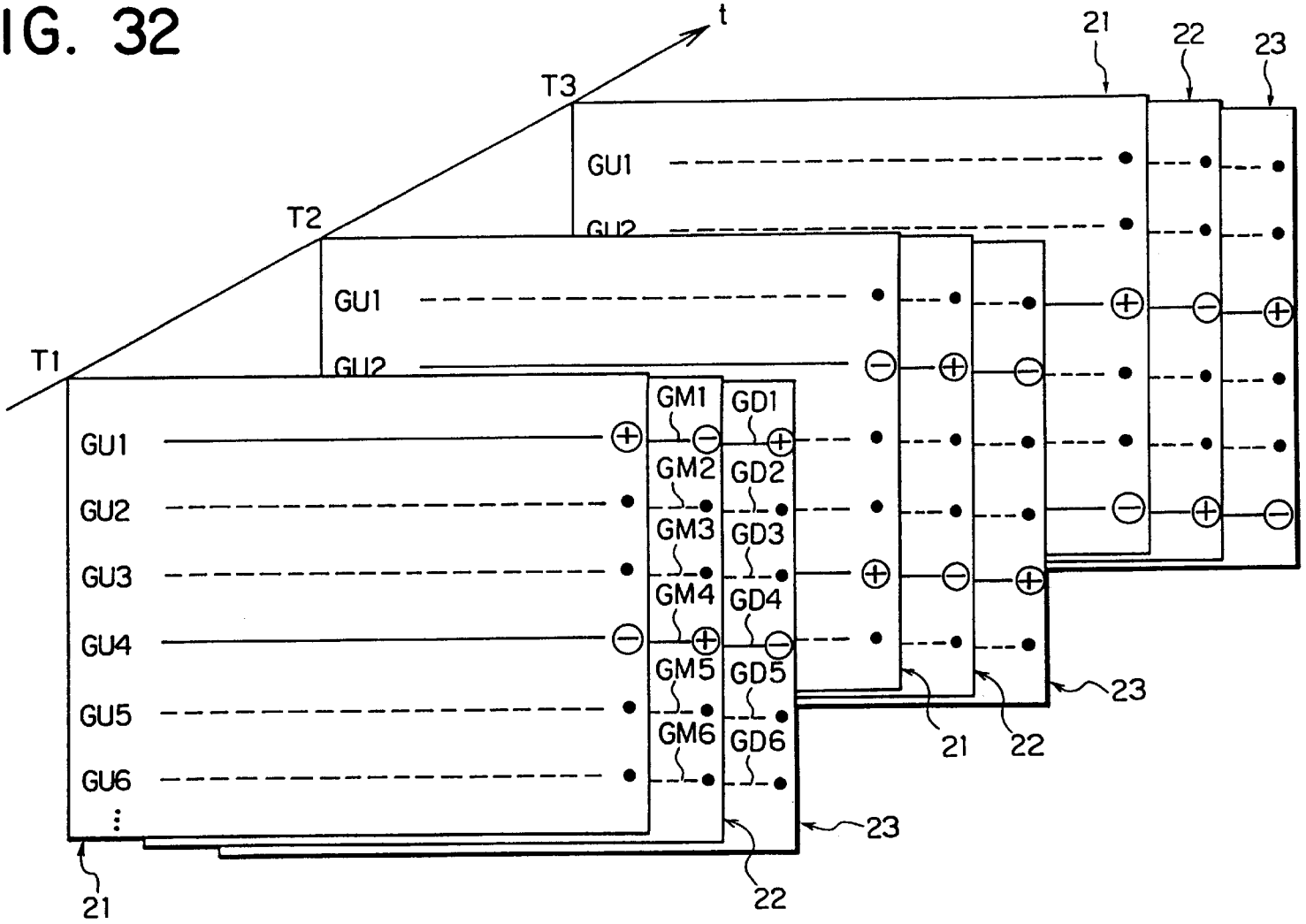
FIG. 32 is a schematic diagram for explaining another example of the driving method of the LCD according to the present invention.

In the driving methods shown in FIG. 30 and FIG. 31, such a problem takes place. In these cases, as described above, each liquid crystal layer is driven corresponding to the contrast ratio of each liquid crystal layer. In the driving methods shown in FIG. 30 and FIG. 31, the liquid crystal layer 23 with the minimum selective ratio is preferably assigned the yellow layer, whereas the liquid crystal layer 21 with the maximum selective ratio is preferably assigned the cyan layer.

As described above, according to an LCD of the present invention, in a plurality of liquid crystal cells having a plurality of pixels arranged in a matrix shape having a plurality of sub-fields, pixels that compose picture elements are selected and driven so that the brightness difference between picture elements in individual sub-fields is compensated. Thus, the power consumption of the LCD can be decreased without a deterioration of the picture quality.

In addition, according to an LCD of the present invention, even if picture elements are composed of a plurality of pixels that are stacked, the drive voltages of the pixels can be fully and independently controlled. Thus, the influence of a pixel of one picture element to other pixels thereof can be prevented. Consequently, the picture quality can be further improved.

Moreover, according to an LCD of the present invention, the number of inter-layer connections can be decreased. Thus, the loft of the interconnection can be decreased. Consequently, the productivity of the LCD and the reliability thereof can be improved.

Although the present invention has been shown and described with respect to a best mode embodiment thereof, it should be understood by those skilled in the art that the foregoing and various other changes, omissions, and additions in the form and detail thereof may be made therein without departing from the spirit and scope of the present invention.

What is claimed is:

1. A driving method for a liquid crystal display device having a first liquid crystal cell having first pixels arranged in a matrix shape and driven in a first sub-field, said first pixels having first pixel electrodes connected to first address lines, a second liquid crystal cell stacked on said first liquid crystal cell, and second liquid crystal cell having second pixels arranged in a matrix shape and driven in a second sub-field, said second pixels having second pixel electrodes connected to second address lines, and a third liquid crystal cell stacked on said second liquid crystal cell, said third liquid crystal cell having third pixels arranged in a matrix shape and driven in a third sub-field, third pixels having third pixel electrodes connected to third address lines, said driving method comprising:

selecting first selected address lines in said first address lines at regular intervals for said first sub-field;

selecting second selected address lines in said second address lines at regular intervals for said second sub-field;

selecting third selected address lines in said third address lines at regular intervals for said third sub-field; and supplying a signal having one of positive and negative polarities in turn to all pixel electrodes on said first selected address lines, said second selected address lines, and said third selected address lines, wherein said first selected address lines, said second selected address lines, and said third selected address lines are sequential on said display device.

2. A driving method as set forth in claim 1, wherein said first liquid crystal cell is controlled by said first pixel electrodes and said second pixel electrodes, said second liquid crystal cell is controlled by said second pixel electrodes and said third pixel electrodes, and said third crystal cell is controlled by said third pixel electrodes and a counter electrode.

3. A driving method as set forth in claim 1, wherein said first selected address lines have two-line intervals, said second selected address lines have two-line intervals, and said third selected address lines have two-line intervals.

4. A driving method for a liquid crystal display device having a first liquid crystal cell having first pixels arranged in a matrix shape and driven in a first sub-field, said first pixels having first pixel electrodes connected to first address lines, second liquid crystal cell stacked on said first liquid crystal cell, said second liquid crystal cell having second pixels arranged in a matrix shape and driven in a second sub-field, said second pixels having second pixel electrodes connected to second address lines, and a third liquid crystal cell stacked on said second liquid crystal cell, said third liquid crystal cell having third pixels arranged in a matrix shape and driven in a third sub-field, said third pixels having third pixel electrodes connected to third address lines, said driving method comprising:

selecting first selected address lines from said first address lines at regular intervals for said first sub-field;

selecting second selected address lines from said second address lines at regular intervals for said second sub-field;

selecting third selected address lines from said third address lines at regular intervals for said third sub-field; and supplying a signal having one of positive and negative polarities in turn to all pixel electrodes on said first selected address lines, said second selected address lines, and said third selected address lines, wherein said first selected address lines, said second selected address lines, and said third address lines are overlaid on said display device.

5. A driving method as set forth in claim 4, wherein said first liquid crystal cell is controlled by said first pixel electrodes and said second pixel electrodes, said second liquid crystal cell is controlled by said second pixel electrodes and said third pixel electrodes, and said third liquid crystal cell is controlled by said third pixel electrodes and a counter electrode.

6. A driving method as set forth in claim 4, wherein said first liquid crystal cell is controlled by said first pixel electrodes and a first counter pixel electrode, said second liquid crystal cell is controlled by said second pixel electrodes and a second counter electrode, and said third liquid crystal cell is controlled by said third pixel electrodes and a third counter electrode.

7. A driving method as set forth in claim 4, wherein said first selected address lines have two-line intervals, said second selected address lines have two-line intervals, and said third selected address lines have two-line intervals.

8. A driving method for a liquid crystal display device having a first liquid crystal cell having first pixels arranged in a matrix shape and driven in a first sub-field, said first pixels having first pixel electrodes connected to first address lines, a second liquid crystal cell stacked on said first liquid crystal cell, said second liquid crystal cell having second pixels arranged in a matrix shape and driven in a second sub-field, said second pixels having second pixel electrodes connected to second address lines, and a third liquid crystal cell stacked on said second liquid crystal cell, said third liquid crystal cell having third pixels arranged in a matrix shape and driven in a third sub-field, said third pixels having third pixel electrodes connected to third address lines, said driving method comprising:

selecting first selected address lines from said first address lines at regular intervals for said first sub-field;

selecting second selected address lines from said second address lines at regular intervals for said second sub-field, said second selected address lines overlaying said first selected address lines;

selecting third selected address lines from said third address lines at regular intervals for said third sub-field, said third selected address lines overlaying said second selected address lines;

supplying a signal having one of positive and negative polarities to pixel electrodes on said first selected address lines and said third selected address lines; and supplying a signal having the other of positive and negative polarities to pixel electrodes on said second selected address lines.

9. A driving method as set forth in claim 8, wherein said first liquid crystal cell is controlled by said first pixel electrodes and said second pixel electrodes, said second liquid crystal cell is controlled by said second pixel electrodes and said third pixel electrodes, and said third liquid crystal cell is controlled by said third pixel electrodes and a counter electrode.

10. A driving method as set forth in claim 8, wherein said first liquid crystal cell is controlled by said first pixel electrodes and a first counter pixel electrode, said second liquid crystal cell is controlled by said second pixel electrodes and a second counter electrode, and said third liquid crystal cell is controlled by said third pixel electrodes and a third counter electrode.

11. A driving method as set forth in claim 8, wherein said first selected address lines have two-line intervals, said second selected address lines have two-line intervals, and said third selected address lines have two-line intervals.

* * * * *